US007446248B2

(12) United States Patent
Skinn et al.

(10) Patent No.: US 7,446,248 B2
(45) Date of Patent: Nov. 4, 2008

(54) APPARATUS AND METHOD FOR SELF-TUNING STRINGED MUSICAL INSTRUMENTS WITH AN ACCOMPANYING VIBRATO MECHANISM

(75) Inventors: Neil Skinn, Fort Collins, CO (US); Frank Strazzabosco, Erie, CO (US); Steve Kith, Morrison, CO (US); Bryan S. Johnson, deceased, late of Loveland CO (US); by Sharon R. Stanberg, legal representative, Loveland, CO (US)

(73) Assignee: Transperformance, LLC, Fort Collins, CO (US)

( * ) Notice: Subject to any disclaimer, the term of this patent is extended or adjusted under 35 U.S.C. 154(b) by 0 days.

(21) Appl. No.: 11/207,187

(22) Filed: Aug. 18, 2005

(65) Prior Publication Data

US 2006/0037459 A1 Feb. 23, 2006

Related U.S. Application Data

(60) Provisional application No. 60/602,385, filed on Aug. 18, 2004.

(51) Int. Cl.
*G10D 1/08* (2006.01)

(52) U.S. Cl. ..... 84/312 R; 84/454

(58) Field of Classification Search ..... 84/312 R, 84/313, 455, 454

See application file for complete search history.

(56) References Cited

U.S. PATENT DOCUMENTS 2,136,627 A 11/1938 Lohman
3,144,802 A 8/1964 Faber, Jr. et al.
4,044,239 A 8/1977 Shimauchi et al.
4,088,052 A 5/1978 Hedrick
4,100,832 A 7/1978 Peterson
4,160,401 A 7/1979 Tomioka
4,196,652 A 4/1980 Raskin (Continued)

*Primary Examiner*—Lincoln Donovan
*Assistant Examiner*—Jianchun Qin
(74) *Attorney, Agent, or Firm*—Greenlee, Winner and Sullivan, P.C.

(57) ABSTRACT

An automatic tuning system for a stringed instrument is provided having a string adjustment assembly comprising a motor and gear assembly, wherein the motor and gear assembly is pivotable on a housing for the tuning system. The system can also include a vibrato arm in contact with the motor and gear assembly, and a vibrato return spring in contact with both the motor and gear assembly and the instrument, which is capable of reversibly changing the position of a string contact surface in the string adjustment assembly with respect to the string, thereby lowering the pitch of the string and then raising it to its original pitch. The system can also include an option board for wireless communication with remote components such as a remote footswitch or other type of control panel. Other remote devices may also be wirelessly connected to the tuning system, including other instruments, audio devices for receiving sound, and the like. The system comprises a processor that can be preprogrammed with generic instructions for motor movement to achieve specific pitch changes and can also be programmed to store the motor instructions required to achieve specific pitch changes each time the system performs an automatic tuning correction, and to utilize these instructions the next time the system is tuned. The system is capable of performing fine tuning corrections as well as of prompting a user to perform coarse-tuning corrections. It also allows a user to change tunings while playing.

26 Claims, 13 Drawing Sheets

U.S. PATENT DOCUMENTS

| | | | | | |
|---|---|---|---|---|---|
| 4,207,791 | A | | 6/1980 | Murakami | |
| 4,313,361 | A | | 2/1982 | Deutsch | |
| 4,327,623 | A | | 5/1982 | Mochida et al. | |
| 4,338,846 | A | | 7/1982 | Pogoda | |
| 4,375,180 | A | | 3/1983 | Scholz | |
| 4,426,907 | A | | 1/1984 | Scholz | |
| 4,434,696 | A | | 3/1984 | Conviser | |
| 4,457,203 | A | | 7/1984 | Schoenberg et al. | |
| 4,512,232 | A | | 4/1985 | Schaller | |
| 4,535,670 | A | | 8/1985 | Borisoff | |
| 4,584,923 | A | | 4/1986 | Minnick | |
| 4,665,790 | A | | 5/1987 | Rothschild | |
| 4,732,071 | A | | 3/1988 | Deutsch | |
| 4,742,750 | A | * | 5/1988 | Storey | 84/313 |
| 4,803,908 | A | | 2/1989 | Skinn et al. | |
| 4,856,404 | A | | 8/1989 | Hughes, Sr. | |
| 4,909,126 | A | | 3/1990 | Skinn et al. | |
| 4,947,726 | A | | 8/1990 | Takabayashi | |
| 4,958,550 | A | | 9/1990 | Kugimoto | |
| 5,009,142 | A | * | 4/1991 | Kurtz | 84/454 |
| 5,025,704 | A | * | 6/1991 | Davis | 84/723 |
| 5,038,657 | A | | 8/1991 | Busley | |
| 5,065,660 | A | | 11/1991 | deBuda | |
| 5,095,797 | A | | 3/1992 | Zacaroli | |
| 5,323,680 | A | | 6/1994 | Miller et al. | |
| 5,343,793 | A | | 9/1994 | Pattie | |
| 5,390,579 | A | | 2/1995 | Burgon | |
| 5,438,902 | A | | 8/1995 | Baker | |
| 5,767,429 | A | | 6/1998 | Milano et al. | |
| 5,824,929 | A | | 10/1998 | Freeland et al. | |
| 5,859,378 | A | | 1/1999 | Freeland et al. | |
| 5,886,270 | A | * | 3/1999 | Wynn | 84/313 |
| 5,977,467 | A | * | 11/1999 | Freeland et al. | 84/454 |
| 6,066,790 | A | | 5/2000 | Freeland et al. | |
| 6,166,307 | A | | 12/2000 | Caulkins et al. | |
| 6,184,452 | B1 | | 2/2001 | Long et al. | |
| 6,278,047 | B1 | * | 8/2001 | Cumberland | 84/455 |
| 6,415,584 | B1 | * | 7/2002 | Whittall et al. | 84/312 R |
| 2003/0177894 | A1 | * | 9/2003 | Skinn | 84/730 |

* cited by examiner

APPARATUS AND METHOD FOR SELF-TUNING STRINGED MUSICAL INSTRUMENTS WITH AN ACCOMPANYING VIBRATO MECHANISM

CROSS-REFERENCE TO RELATED APPLICATIONS

This application claims priority to U.S. Provisional Application Ser. No. 60/602,385 filed Aug. 18, 2004, which is incorporated herein by reference to the extent not inconsistent herewith.

BACKGROUND

Certain automatic tuning systems for stringed instruments have been described in the art.

U.S. Pat. No. 5,824,929 issued Oct. 20, 1998 to Freeland et al. for "Musical Instrument Self-Tuning System with Calibration Library describes an automatic open-loop self-tuning system using a library of calibration functions for setting an actuator position for tuning a stringed instrument under different sets of conditions, e.g., temperature, humidity, and instrument characteristics. This patent relies on art-known actuators to effect the tuning corrections. It uses "open-loop feedback" in the sense that it stores actuator settings from a previous tuning correction and uses them in a subsequent tuning correction. U.S. Pat. No. 5,859,378 issued Jan. 12, 1999 to Freeland et al., for "Musical Instrument Self-Tuning System with Capo Mode" discloses methods for calculating tuning adjustments required to tune a stringed instrument after installation of a capo. It relies on art-known mechanical configurations for actually changing string frequencies.

U.S. Pat. No. 5,767,429 issued Jun. 16, 1998 to Milano et al. for "Automatic String Instrument Tuner" describes an automatic tuning system using closed-loop feedback and a motor and gear arrangement with a transmission to successively apply the motor output to different strings. U.S. Pat. No. 5,343,793 issued Sep. 6, 1994 to Pattie for "Automatically Tuned Musical Instrument" discloses an automatic tuning system having motors to adjust string tension by winding the string around the motor shaft. This system uses "closed-loop feedback" in that it does not refer to stored actuator positions in making frequency adjustments. U.S. Pat. No. 5,323,680 issued Jun. 28, 1994 to Miller et al for "Device and Method for Automatically Tuning a Stringed Musical Instrument" discloses a tuning mechanism that uses a linear actuator to deflect a string sideways to adjust its frequency. U.S. Pat. No. 5,065,660 issued Nov. 19, 1991 to deBuda for "Piano Tuning System" provides a handheld device for adjusting piano string tension in response to closed-loop feedback. U.S. Pat. No. 4,909,126 issued Mar. 20, 1990 to Skinn et al. for "Automatic Musical Instrument Tuning System" describes a lever arm and roller assembly for adjusting string tension. No drive gear/string cam components are disclosed. U.S. Pat. No. 4,803,908 issued Feb. 14, 1989 to Skinn et al. for "Automatic Musical Instrument Tuning System" discloses adjusting string tension by means of a dowel pin with levers and rollers. No drive gear/string cam components are used. U.S. Pat. No. 4,856,404 issued Aug. 15, 1989 to Hughes, Sr. for "Guitar with Tuning Changing, Key Changing, Chord Changing and Modulating Capabilities discloses a tuning method requiring manual adjustment of string tension. U.S. Pat. No. 4,535,670 issued Aug. 20, 1985 to Borisoff for "String Bender Attachment Construction" also discloses a manual system for changing string tension. U.S. Pat. No. 4,584,923 issued Apr. 29, 1986 to Minnick for "Self Tuning Tail Piece for String Instruments" discloses an automatic tuning device using closed-loop feedback and acme screws and levers to adjust tension. U.S. Pat. No. 4,426,907 issued Jan. 24, 1984 to Scholz for "Automatic Tuning Device" discloses an automatic tuning device that works by sensing string tension rather than frequency. U.S. Pat. No. 4,375,180 issued Mar. 1, 1983 to Scholz for "Automatic Tuning Device" also discloses an automatic tuning device that works by sensing string tension rather than frequency. U.S. Pat. No. 4,088,052 issued May 9, 1978 to Hedrick for "String Instrument Tuning Apparatus" discloses a separate handheld tuning device actuated by a cable system.

A number of patents disclose tuning systems having means for producing vibrato effects. U.S. Pat. No. 6,415,584 issued Jul. 9, 2002 to Whittall et al. for "Tuning Means for Tuning Stringed Instruments, a Guitar Comprising Tuning Means and a Method of tuning Stringed Instruments" discloses a multistage epicyclic gearbox where the string wraps around the output peg for tension adjustment. It discloses the use of a fulcrum-style vibrato. device. U.S. Pat. No. 5,886,270 issued May 23, 1999 to Wynn for "Electromechanical Tuner for Stringed Instruments: also discloses a fulcrum-style vibrato device using a double-hinged tremolo system. U.S. Pat. No. 4,390,579 issued Feb. 21, 1995 to Burgon for "Tuning of Musical Instruments" discloses the use of a spring to tension the strings and a moveable carriage that runs on a rack to produce vibrato effects. U.S. Pat. No. 5,038,657 issued Aug. 13, 1991 to Busley for "String Tensioning Apparatus for a Musical Instrument" discloses an automatic tuning system comprising motors with shafts around which strings are wound to adjust tension. It has a joystick device simulating a conventional vibrato arm or a joyball that electronically controls vibrato effects. U.S. Pat. No. 5,095,797 issued Mar. 17, 1992 to Zacaroli for "Automatic Tone Control for Stringed Musical Instruments" discloses a tuning systems that uses shape memory metal to control string tension and resistors to produce tremolo effects. U.S. Pat. No. 4,160,401 issued Jul. 10, 1979 to Tomioka for "String Vibration Transducer Bridge for Electric Stringed Instruments" discloses a piezoelectric pushing mechanism for adjusting string tension. Tremolo can be applied through the use of resistors. U.S. Pat. No. 5,438,902 issued Aug. 8, 1995 to Baker for "Memory Tuning System for String Instruments" discloses a tuning device using levers and cams and capable of providing vibrato effects by activating a bar that tilts a tremolo base element. U.S. Pat. No. 5,009,142 issued Apr. 23, 1991 to Kurtz for "Means and Method for Automatic Resonance Tuning" discloses an automatic tuning device that uses piezoelectric pushers to adjust string tension, and creates vibrato effects by changes in voltage.

Further U.S. patents disclose tuning systems that involve communication of system components with remote components. U.S. Pat. No. 6,278,047 issued Aug. 21, 2001 to Cumberland for "Apparatus for Tuning Stringed Instruments" discloses a tuning device that works by sensing tension on a string rather than frequency. It can be wirelessly connected to a computer connected to the drivers that tighten the string. U.S. Pat. No. 6,184,452 issued Feb. 6, 2001 to Long et al. for "Tuning of Musical Instruments" discloses the use of a single motor and clutch system to drive output screws for applying string tension. No strumming of the strings is required. The tuning device may be operated by remote control. U.S. Pat. No. 6,166,307 issued Dec. 26, 2000 to Caulkins et al. for "Apparatus for Automating a Stringed Instrument" discloses a stringed instrument in which an outside computer can control tuning by conventional means without the need for manually strumming the strings. U.S. Pat. No. 4,338,846 issued Jul.

13, 1982 to Pogoda for "Remote Control for Electronic Musical Instrument Equipment" discloses a manually operated switch located on an electric guitar that controls a remotely located tuning device through the existing guitar cable. It does not disclose string-tensioning mechanisms.

U.S. Patent Publication No. 2003/0177894 published Sep. 25, 2003 of Skinn for "Piezo Rocker Bridge" discloses a moveable-saddle bridge having rocker components for allowing substantially frictionless string movement as string tension is adjusted. Also disclosed are piezoelectric pickup designs to allow automatic tuning devices to be operated by strumming all strings at once.

Other patents relevant to automatic tuning systems include U.S. Pat. Nos. 3,144,802, 4,044,239, 4,196,652, 4,947,726, 4,958,550, 4,207,791, 4,313,361, 4,732,071, 4,327,623, 2,136,627, 4,100,832, 4,434,696, 4,457,203, 4,512,232, and 4,665,790.

All publications referred to herein are incorporated by reference to the extent not inconsistent herewith for their teachings of various devices and methods useful in this invention. Any feature disclosed in any such publication that is not specifically disclosed in the following description of the present invention may be excluded in embodiments of this invention.

SUMMARY OF THE INVENTION

This invention provides an automatic tuning system to allow accurate and rapid changes to the notes of the individual strings of a stringed instrument, and to perform automatic fine tuning corrections on a stringed instrument when initiated by the user. The tuning system comprises: a detector for detecting a first musical tone produced by an activated string and producing a signal value corresponding to said tone; a processor coupled to said detector for comparing said signal to a reference frequency value associated with a desired frequency and producing an electrical control signal, said electrical control signal being a function of the difference between said signal value and said reference frequency value; and a string adjustment assembly coupled to said processor and to said string for adjusting the tension of said string in dependence upon said electrical control signal, said string adjustment assembly comprising a motor and gear assembly pivotally attached to a housing for said automatic tuning system. These tuning system components are designed to operate with a vibrato arm as described below.

The term "automatic" with respect to the tuning system of this invention means that the tension of the strings can be automatically adjusted by the mechanical components of this invention to make fine tuning corrections that are accurate and reproducible.

"Fine tuning corrections" are changes in string tension that can be automatically made by the system. Due to physical-mechanical limitations, the difference between a desired string frequency and an actual string frequency can be greater than the tuning mechanisms of this invention can handle. For example, the drive gear/string cam of this invention is typically designed to have about 15 degrees of rotational freedom in response to the motors governing its movement, and can automatically change string tension only within these limits of rotational freedom. Therefore, the tuning system and tuning procedures of this invention also allow for preliminary coarse tunings as described below when such coarse tunings are required.

The automatic tuning system can also comprise a vibrato assembly comprising a vibrato arm in operational contact with the motor and gear assembly, and a vibrato return spring in operational contact with both the motor and gear assembly and said instrument, the vibrato assembly being capable of reversibly changing the position of the string contact surface of the drive gear/string cam of the tune arm assembly with respect to the string, thereby lowering the pitch of said string and then raising it to its original pitch. The term "vibrato" refers to reversible changes in the pitch of a tone (as contrasted with "tremolo" which refers to reversible changes in the volume of a tone). The "vibrato arm" is a lever which, when operated, pulls on an end of the gear and motor assembly in a piston fashion and causes it to rotate on an axle pivotally attached to the tuning system housing, in turn causing the tune arm assembly that is connected to the gear and motor assembly to rotate on a tune arm axle also pivotally attached to the tuning system housing. The return spring is attached to the other end of the gear and motor assembly from the end that is connected to the vibrato arm, and is also attached to the housing for the tuning system, so that it causes the gear and motor assembly (and the tune arm assembly connected to the gear and motor assembly) to return to its initial position. The vibrato arm can be operated one or more times to cause the vibrato effect. "Operational contact" with respect to the components of the vibrato assembly means that operation of one component causes a resultant movement in the component that is in operational contact with it. For example, the vibrato arm of this invention preferably causes rotation of the gear and motor assembly indirectly through a vibrato activator shaft, rather than by directly impinging on the gear and motor assembly.

The string adjustment assembly can also comprise: a tune arm to which the string is anchored; a string contact surface of a drive gear/string cam contained within the tune arm, the string contact surface being in adjustable tangential contact with the string; a gear of the motor and gear assembly in rotational contact with the drive gear/string cam; and a motor of the motor and gear assembly responsive to the electrical signal in rotational contact with the gear train; whereby changing the position of the string contact surface with respect to the string; thereby changing the frequency produced by the string when activated.

The housing for the tuning system can be a separate housing as described hereinafter, or can be the body of the instrument itself, or any component fixedly attached thereto that the motor and gear assembly can be pivotally attached to so as to rotate with respect to the strings.

The motor and gear assembly comprises the motors and gears used to achieve string tension adjustments, said motors and gears being integrated into a single unit that is capable of being pivoted with respect to the housing.

A stringed instrument can be any stringed instrument known to the art including guitars, both electric and acoustic, basses, violins, sitars, harps, pianos, and others. In a preferred embodiment, the instrument comprising the automatic tuning system is a guitar, more preferably an electric guitar. Also in one embodiment, the components of the tuning system are built into the guitar as an integral part thereof. The tuning assembly can be installed when the guitar is manufactured, or can be retrofitted into an existing guitar. In other embodiments, some of the components can be remote from the guitar as hereinafter described.

The detector includes an electronic component or components capable of receiving a tone generated when a string is strummed, and converting the tone to a signal representing the frequency of the tone. Preferably the analog signal of the tone is converted to a digital signal. In an embodiment of this invention, the detector comprises a pickup built into a conventional electric guitar with associated circuitry.

An "activated string" is a string that has been strummed by the user or otherwise caused to vibrate, such as by an automatic string-activating mechanism.

The "processor" is any device that can be programmed or hardwired to perform the automatic functions of this invention. In one embodiment, it is a central processing unit (CPU) board. It can also be a separate computer such as a personal computer, or any other processing device known to the art. The processor is "coupled" to the detector when it is in communication with the detector such as the processor receives a signal generated by the detector that represents the tone produced by activating a string.

The "desired frequency" is the frequency the string should produce when it is tuned in accordance with a particular "tuning."

There are many different "tunings" that are known to the art. For example, standard tuning provides accepted frequencies for each string, from lowest to highest, for the following notes: E, A, D, G, B, and E, using frequency values (Hertz values) generally accepted in the United States. Hertz values for the notes can differ in other times and other countries and are generally referenced to a calibration frequency such as A-440 Hertz or A-442 Hertz using the note A in the fourth octave. Open A tuning tunes the strings to the following notes: E, A, E, A, C#, E. Open G tuning tunes the strings to the following notes: D, G, D, G, B, D. Open D tuning tunes the strings to the following notes: D, A, D, F#, A, D. Dropped-D tuning modifies standard tuning by lowering the sixth string (E) by a whole tone, one octave lower than the fourth string. Equal tempered tuning, as opposed to strictly mathematical tuning using the scale of just intonation (in which each doubling of frequency produces a note of a one octave higher, and each of the 12 half-tones between each octave follow a harmonic series) involves assigning each note a frequency that is slightly different from the mathematically-prescribed tuning so as to yield good, but not perfect, tuning in all keys, and to sound harmonious in all keys. Many other tunings are known to the art, and additional new tunings for use in this invention can be created.

The term "tuning" as used herein is distinguished from the term "tuning correction procedure" which refers to adjusting the tension of a string to produce a "desired frequency," i.e., the frequency mandated by the "tuning" that has been selected by the user.

A "signal value" for a tone may be a number expressed in any units used by the system that corresponds to the frequency of the tone. "Signal values" may be in units that measure string tension, units that measure movement of a stepper motor of this invention, or other units useful for carrying out the automatic tuning procedures of this invention.

A "reference frequency value" for the desired frequency is a number expressed in any units, as defined in the preceding paragraph that corresponds to the desired frequency and is useful for comparing the desired frequency with the frequency of the tone generated when the string is activated.

An "electrical control signal" is a signal that expresses the difference between the signal value and the reference frequency value in any units that are useful to the system for automatically adjusting string tension.

The "string adjustment assembly" includes all the components necessary to automatically adjust string tension. The string adjustment assembly is "coupled" to the processor when a component of the string adjustment assembly is capable of receiving a signal from the processor that directly or indirectly activates a motor to ultimately result in a change in tension on a string. As an example of indirect motor activation, in an embodiment wherein the processor is a CPU board, the CPU board may send an electrical control signal to a motor board which sends a further signal to a motor. Adjustment of the string is dependent on the electrical control signal that expresses the difference between the signal value and the reference frequency value, and can also be dependent on other factors, as more fully described below.

Components of the string adjustment assembly include a tune arm as depicted herein that provides a means for affixing one end of a string. The tune arm contains a drive gear/string cam that has a string contact surface on its upper circumference across which the string is threaded. A string contact surface is a rounded area having a constant radius (distance from the center pivot hole to the circumference) over the rounded portion, so that when the drive gear/string cam is rotated, the rounded area will press on the string at different places, thereby increasing the length of the string, and therefore its tension and frequency. This ability of the string contact surface to press on the string at different places is referred to as the string contact surface being in "adjustable tangential contact" with the string. The rotation of the drive gear/string cam is accomplished by the round bottom portion of the drive gear/string cam being round and having gear teeth that engage with a gear in operational connection with the motor, so that when the motor moves a given distance, the drive gear/string cam will rotate a proportional distance. The gear is thus said to be in "rotational contact" with the drive gear/string cam. The rotational contact can be direct, or indirect, such as through the gear reduction stages described herein.

In one embodiment, the string adjustment assembly comprises a tune arm assembly with associated motor and gears for each string. In other embodiments, a single motor and gear assembly can be successively coupled to each tune arm through a transmission arrangement known to the art.

The motor or motors used in this invention can be any motor known to the art capable of performing the function of producing the required motion of the drive gear/string cam. In one embodiment, the motors are stepper motors, which are devices that translate electrical pulses into precise mechanical movements. The output shaft of a stepper motor can deliver rotary or linear motion. In the present invention, the stepper motor delivers rotary motion. For the motor to be in "rotational contact" with the gear that moves the drive gear/string cam component of the tuner arm, means that the motor shaft is directly in contact with that gear, or is in contact with another gear or gears that contact that gear. In a preferred embodiment, the motor shaft is in contact with a series of gears that successively reduce the rotational movement of the gear that moves the drive gear/string cam so that many rotations of the motor shaft are required to achieve a 15 degree rotation of the drive gear/string cam.

The automatic tuning system of this invention can also comprise a user interface comprising signal components, such as different colored LEDs, instructing a user to activate (such as by strumming) each individual string. In one embodiment, the user is instructed to strum each string in turn, and the frequencies of each string are collected individually. It is also possible to utilize components such as piezoelectric transducers that can collect the signals from all the strings simultaneously, when the strings are strummed or otherwise activated simultaneously. As is known to the art, other types of signal components for communication with the user can be used including digital displays, auditory signals, and the like. The user interface comprises controls such as buttons or switches or other controls known to the art for allowing a user to operate an electromechanical device. The user interface also includes a power control and a button to initiate tuning correction, and controls to select the particular tuning desired by a user of the system.

The automatic tuning system of this invention can also comprise signal components instructing the user to perform a coarse tuning routine comprising manually adjusting the tension of at least one individual string, e.g., by turning the tuning pegs, including signals to inform the user when the string must be manually tightened, loosened, or does not need to be further manually tightened or loosened. Such signals are activated when the difference between the signal value produced by the tone of the activated string and the reference frequency value is greater than a value permitting automatic fine tuning correction of said string as discussed above.

The processor can comprise stored generic predetermined calibration values comprising for motor movement instructions for achieving a number of desired frequency changes for each string. "Generic values" are predetermined taking into account factors affecting string frequency known to the art, as more fully described hereinafter. These are numbers that may be expressed in any units useful for producing the required motor movement. There can be stored generic predetermined calibration values for each string for a plurality of desired tunings, such that if the user wishes to select a particular tuning, activation of the appropriate control for that tuning will trigger the algorithm of this invention, which is programmed or hardwired into the processor, to utilize the corresponding predetermined generic calibration value for each string. The algorithm uses the appropriate stored predetermined generic calibration value to cause the amount of movement of the motor that is necessary to perform an automatic tuning correction on that string.

The algorithm also stores a value for an instruction for motor movement used to perform each tuning correction, referred to herein as an "offset calibration value." The offset calibration values are used along with the generic predetermined calibration values to recalculate the amount of motor movement necessary to perform the next automatic tuning correction on that string.

Using the predetermined generic calibration values and/or offset calibration values from each previous tuning correction is termed "open loop feedback" (as opposed to "closed loop feedback" wherein the system merely compares the actual frequency with the desired frequency and makes a corresponding string adjustment). Open-loop feedback allows the automatic tuning system of this invention to become more accurate each time it is used.

After the automatic tuning correction procedure of this invention has been performed for each string for each desired tuning, as further described hereinafter, using the stored predetermined generic calibration and offset calibration values also allows the user to change to a different tuning without stopping in the middle of his or her performance to strum the instrument or otherwise produce a tone. The user can simply operate a controller that activates an algorithm to change the tension of each string using the stored values for each string for the different tuning desired.

The automatic tuning system of this invention can also comprise an option board (also referred to herein as an "audio transmitter and radio-frequency command and control transceiver") capable of wireless communication with a remote device. The term "remote" in this context means that the device is not physically touching the instrument or any object that physically touches the instrument. The "remote" device can be in the same room as the instrument or can be in any other location from which wireless communication is possible. "Wireless communication" means any communication not using wires or other physical conduits (other than air) for the signals between the option board and the remote device. The remote device can, for example, be the detector or the processor, or a remote control panel or panels, such as a foot switch or hand control device, having a controller to control a system function also controlled by controllers on the above-described user interface assembly, such as power activation, initiation of a tuning correction procedure, detection of a tone, and selection of desired tunings. The control panel(s) can also include controllers for programming the processor, downloading or uploading data or software for use in performing system functions or tuning the instrument to additional tunings, adjusting motor speed, editing, creating, storing and/or recovering previously-used tunings, and updating system software, as well as other desired functions. Other remote devices may also be wirelessly connected to the option board such as other instruments, audio devices for receiving sound, and the like.

The automatic tuning system of this invention can also include a rocker bridge as described herein for setting the vibrating length of the strings for proper tuning intonation and setting the height of the strings in accordance with user preferences. The rocker bridge additionally provides a substantially frictionless, moveable saddle, to keep the friction associated with automatically changing the string length and tension when a conventional bridge is used from interfering with the tuning correction procedure. Tension adjustments are made in the process of this invention by a method that involves lengthening the strings; however, to preserve proper intonation, that is to ensure that the preset fret positions will continue to produce notes having frequencies in the proper ratios, the vibrating length of the string, set by the bridge and the nut, must be kept constant.

The automatic tuning system can also comprise a user interface for selecting different preprogrammed tunings or to instruct a user to activate an individual string of the instrument that has been selected to be tuned. In one embodiment, a green LED light beneath each string indicates to the user that that string should be strummed. The string can be tuned by an automatic fine-tuning correction or the tuning can also include a coarse-tuning step as described above.

This invention also provides a guitar or other stringed instrument comprising the automatic tuning system of this invention.

This invention also includes a method of tuning a stringed instrument comprising: providing the automatic tuning system of this invention, strumming the strings of the instrument, preferably individually in the order prompted by signals on the user interface, and allowing the tuning system to automatically perform fine tuning corrections on any string of said instrument requiring correction. The method can also include, after strumming each individual string, manually performing a coarse tuning of each string requiring coarse tuning before allowing the tuning system to automatically perform the fine tuning corrections.

This invention also provides a method for changing the tuning of a stringed instrument to a different tuning while playing the instrument without having to strum any string of the instrument by operating a controller to activate an algorithm that causes all strings of the instrument to be automatically adjusted as required for the different tuning using stored or preset values for motor movement instructions for the different tuning. This method can only be properly performed after all strings have had the fine-tuning correction procedure done for each string for both tunings.

The invention is further illustrated and described with respect to specific embodiments in the Detailed Description below.

DETAILED DESCRIPTION

In the figures, like numerals indicate like parts and structural features in the various figures.

Figure 1:
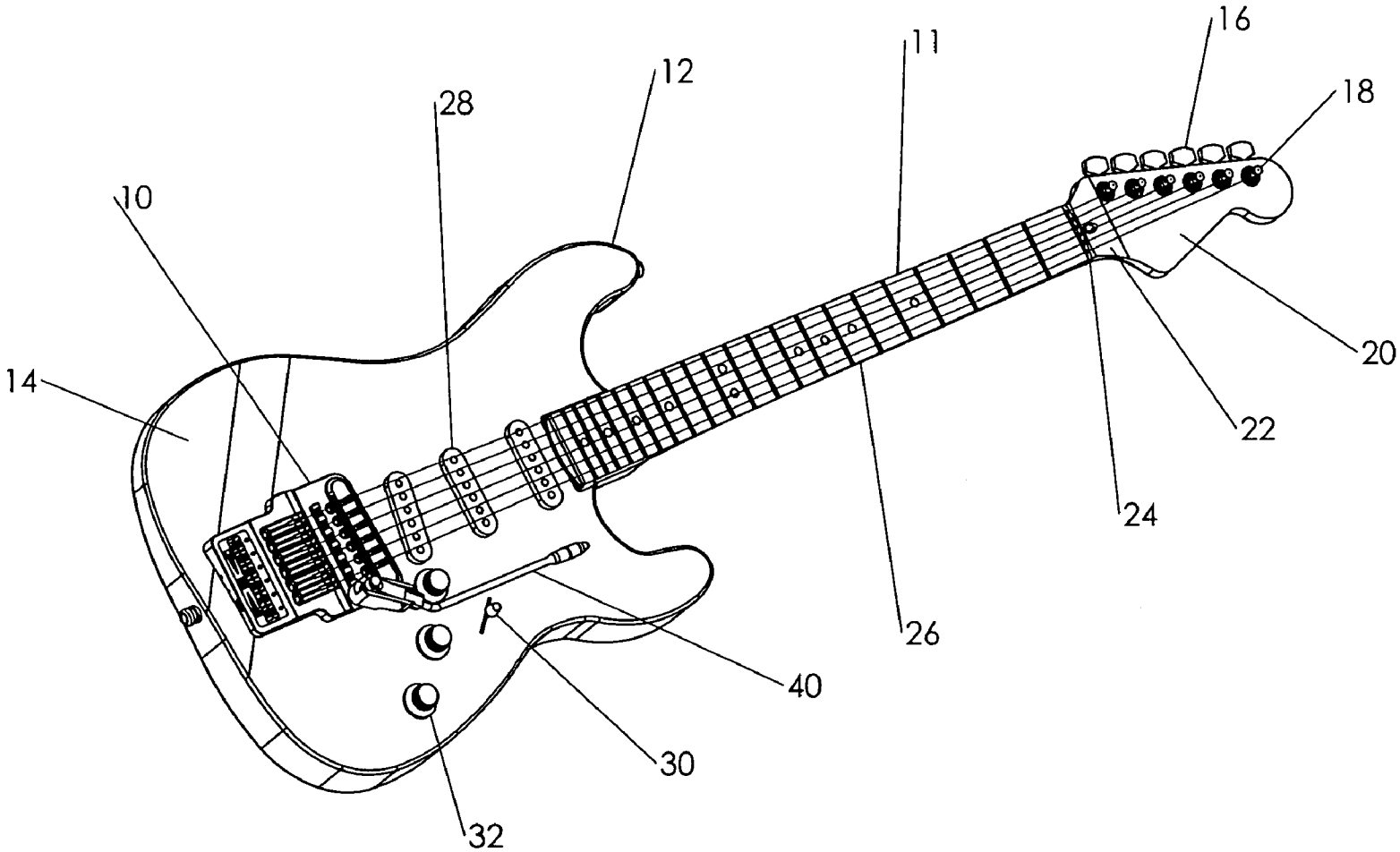
FIG. 1 is a top view of a conventional electric guitar fitted with a tuning system of this invention.

FIG. 1 is a top view of a conventional electric guitar fitted with a tuning system 10 of this invention. The guitar comprises a body 12 having standard features such as strings 11, a comfort curve 14, tuners 16, tuning pegs 18, a head stock 20, nut 24, which is a bar having slots in which the strings rest to guide them to the tuning pegs 18 and hold their spacing, a location for an optional string lock 22, which can be attached to headstock 20 to capture the strings to prevent the strings 11 from slipping in nut 24 when changing string tensions, guitar neck 26, guitar pickups 28 for electronically capturing the sound produced by the strings 11 for amplification by amplifiers (not shown), a guitar pickup selector switch 30 to allow the user to selectively electrically connect the pickups and combinations thereof to an amplifier or other component, and volume and tone controls 32. In one embodiment of the invention, tuning system 10 comprises a vibrato arm 40.

Figure 2:
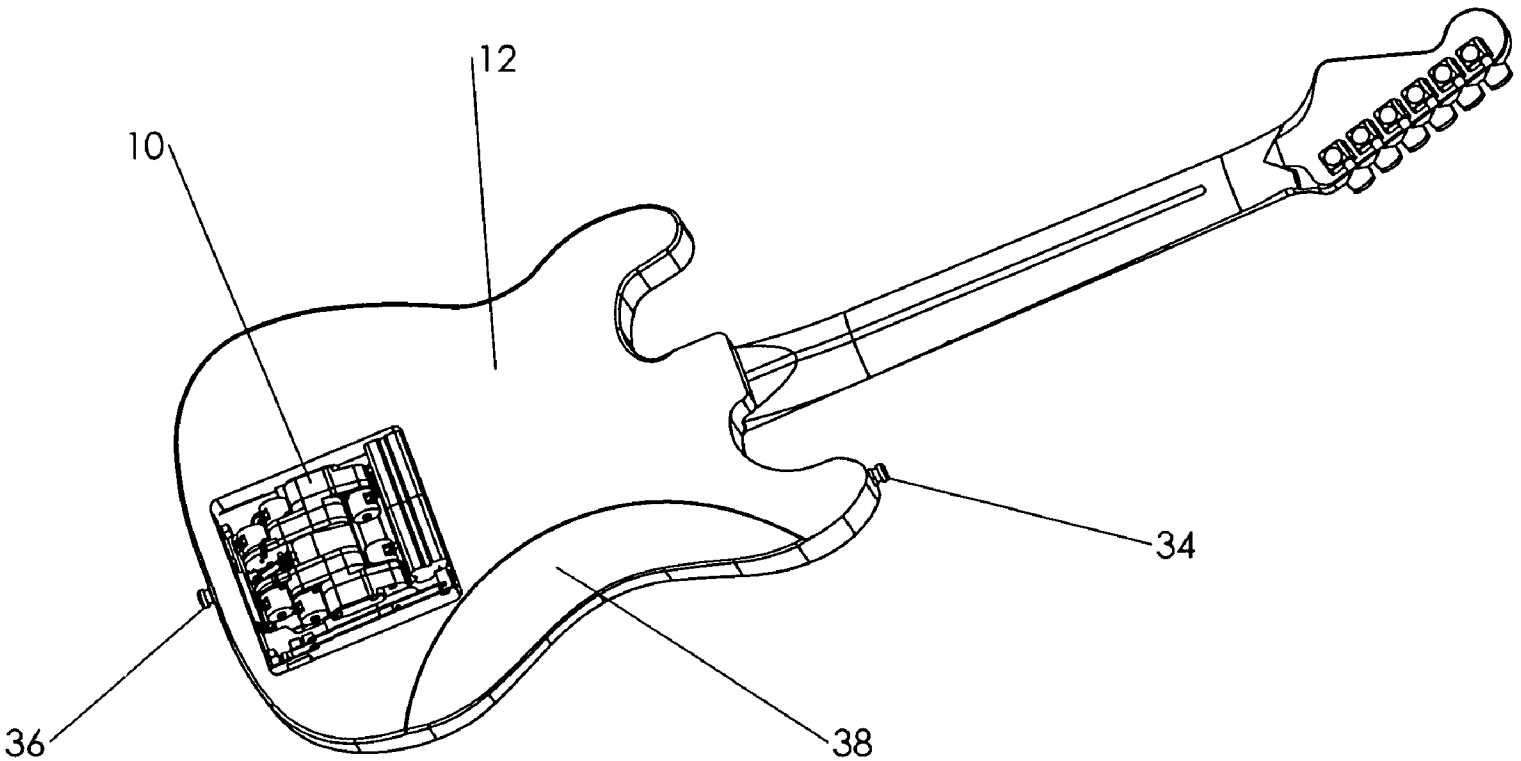
FIG. 2 is a bottom view of a conventional electric guitar fitted with a tuning system of this invention.

FIG. 2 is a bottom view of the conventional guitar of FIG. 1 showing the underside of the tuning system 10 of this invention as installed in a conventional electric guitar. A base plate (not shown) set flush with the back of guitar body 12 covers tuning system 10 when the guitar is in use. Conventional features include top strap pin 34, belly cut 38 and bottom strap pin 36.

Figure 3:
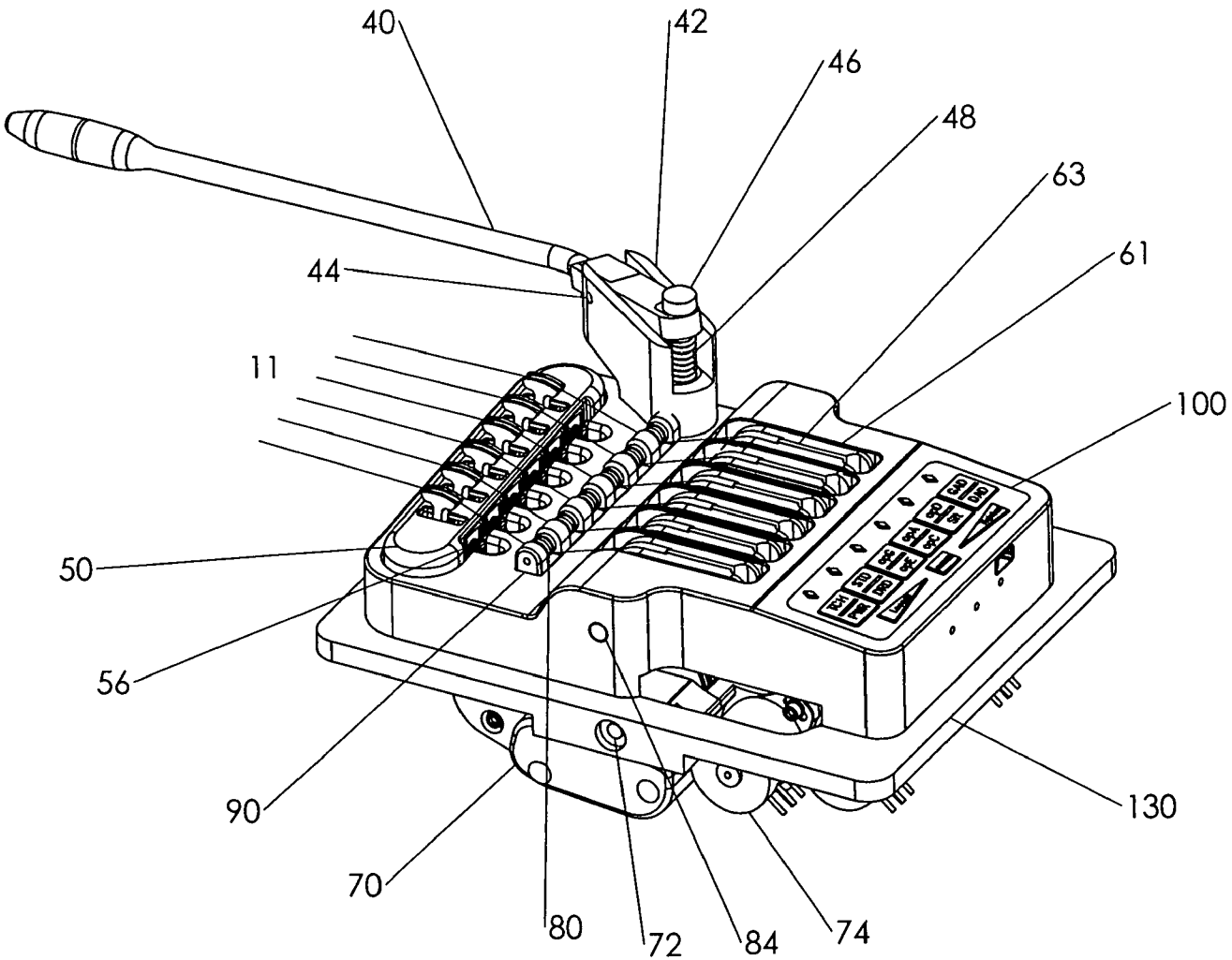
FIG. 3 is a perspective top view of a tuning system of this invention (without computer or option board)
Figure 5:
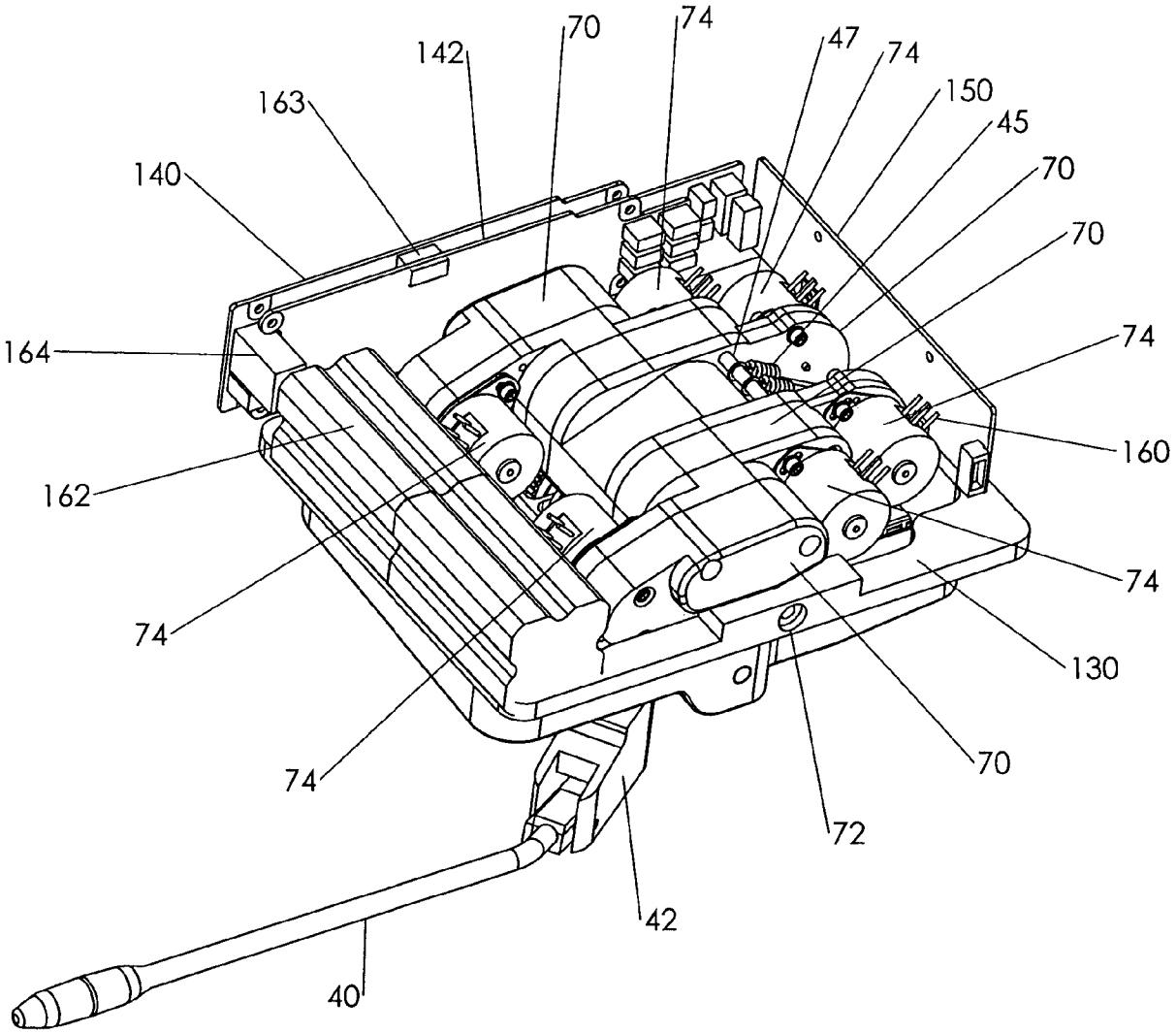
FIG. 5 is a bottom view of a tuning system of this invention.

FIG. 3 is perspective top view of a tuning system 10 of this invention (without CPU board 140, motor driver board 142, or audio transmitter and radio-frequency command and control transceiver 150, all of which are shown in FIG. 5). The system comprises a motor and gear assembly comprising a gearbox 70 containing gears (shown in FIG. 6) and stepper motors 74 to which the gears are operationally connected (one motor being operationally connected to each string). The gear box is pivotally attached to upper housing 130 by means of gearbox pivot 72.

The tuning system 10 also comprises an optional vibrato assembly comprising a vibrato arm 40, pivotally attached via pivot 44 to vibrato housing 42, in which is disposed activator shaft 46 extending through a hole in the proximal end of vibrato arm 40, and surrounded by vibrato tension spring 48. Vibrato tension spring 48 provides tension to the vibrato arm assembly to eliminate vibration in the linkages. The activator shaft 46 extends through hole 41 (see FIG. 11) of the upper housing 130 of the tuning system 10 and is fixedly attached to gearbox 70.

Tuning system 10 also comprises a rocker bridge assembly 50 (further illustrated in FIGS. 9 and 10) seated in upper housing 130, and comprising intonation adjust screws 56 and rockers 52 in which strings 11 are received. Strings 11 pass under string guide assembly 90 comprising conventional string guide rollers 80, and into slots 63 in tune arms 61 of tune arm assembly 60.

Tune arms 61 are pivotally mounted on tune arm axle 84 which is supported in upper housing 130. The tune arm assembly is more fully illustrated in FIGS. 7 and 8.

Tuning system 10 also comprises user interface panel assembly 100 supported by upper housing 130. The user interface panel assembly is more fully illustrated in FIG. 4.

Figure 4:
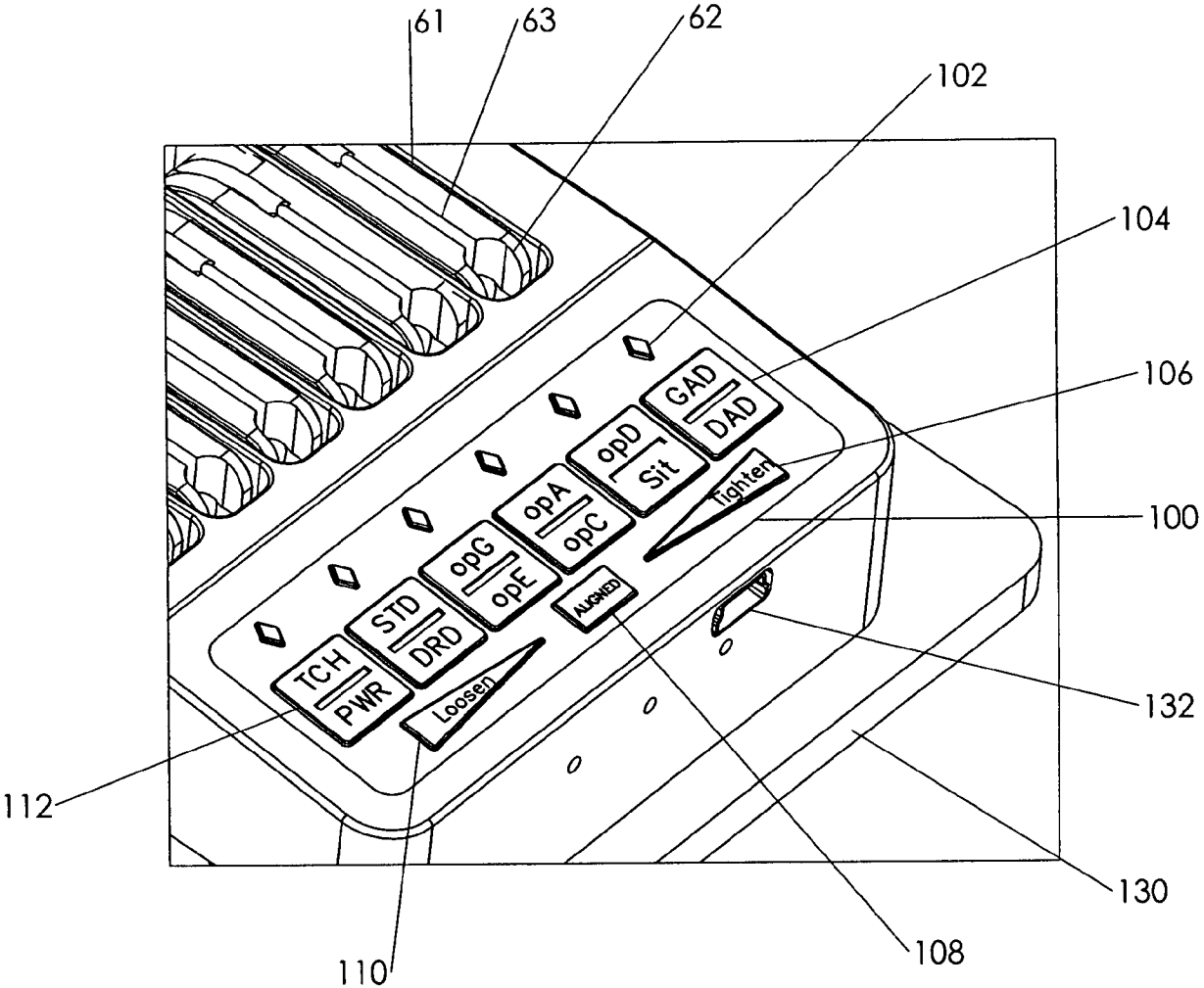
FIG. 4 is an enlarged view of a portion of the tuning system of FIG. 3.

FIG. 4 is an enlarged view of a portion of the tuning system of FIG. 3 showing tune arms 61 and user interface panel assembly 100. User interface panel 100 comprises a key pad containing the visible portion of the top of interface panel assembly 100 that can be adhesively attached to the upper housing 130 and connected to a user interface board 131 (shown in FIG. 11) beneath this visible top portion, the user interface board 131 comprising six tricolor LEDs 102, one associated with each string, to instruct the user which string to strum (preferably the associated LED is green when the string should be strummed) during the tuning procedure of this invention and which strings to mute (preferably the associated LED is red when a string should be muted), and when not to touch the string because the device is acquiring the frequency of the tone emitted when the string was strummed (preferably the associated LED is yellow when a string should not be touched). The user interface also includes a number of push buttons. When the power is off, power/touchup button 112 turns on tuning assembly 10 when depressed. When the system is powered on and power/touchup button 112 is momentarily depressed then released, a "touch up" tuning procedure is initiated as described hereinafter. The system will then power back off when power/touchup button 112 is depressed and held down for a short period of time. Tighten string indicator 106 when lit instructs the user to manually tighten the string being tuned. Loosen string indicator 110 when lit instructs the user to manually loosen the string being tuned. Aligned in-tune indicator 108 when lit informs the user that no further manual adjustments are required. Manual adjustments are needed only if the string tensions are out of the operational range in which automatic adjustments can take place; otherwise the tuning system will complete the tuning process automatically. Tuning selector buttons 104 allow the user to select a set of frequencies to which the strings will be tuned, e.g., "STD" for standard tuning, "DRD" for Drop D tuning, "opG" for open G tuning, "opE" for open E tuning, "opA" for open A tuning, "opC" for open C tuning, "opD" for open D tuning, "Sit" for sitar tuning, "GAD" for DADGAD tuning, and "DAD" for DADDAD tuning. For example, the tuning changes between STD and DRD each time you press and release the STD/DRD button, and there are LEDs under each button that light up to tell you when you're in STD versus DRD. These tuning selector buttons 104 having a toggling action, such that when STD is selected for example, an LED under the STD portion of the button lights up the STD label while the DRD portion of the button label is dark, and vice versa.

FIG. 4 also shows an enlarged view of tune arm 61 showing slot 63 and string ball capture recess 62. FIG. 4 further shows the power and USB (Universal Serial Bus) input-output port 132 through which power for the battery pack 162 (FIG. 5) for recharging from an external battery charger (not shown) and digital data signals are fed into and out of the device, or to a host USB device, such as a personal computer (also not shown).

FIG. 5 is a bottom view of a tuning system of this invention. The underside of vibrato arm 40 and vibrato housing 42 are shown, as well as the motor and gear assembly comprising stepper motors 74 and associated power signal wires 160, and gear box 70, disposed within and pivotally attached via gearbox pivot 72 to upper housing 130. Depression of vibrato arm 40 by the user causes the motor and gear assembly to pivot on gearbox pivot 72, causing the tune arms 61 to which it is operationally connected to rotate through an arc of approximately 15 degrees, thus relieving tension on the strings and lowering the frequencies of the sounds generated by the strings, and when the user releases vibrato arm 40, vibrato return springs 45 connected to vibrato spring anchor 47 and to upper housing 130 cause it to return to its beginning position, returning the strings to their original position and raising the frequencies of the sounds they generate, thus producing a vibrato effect.

Figure 11:
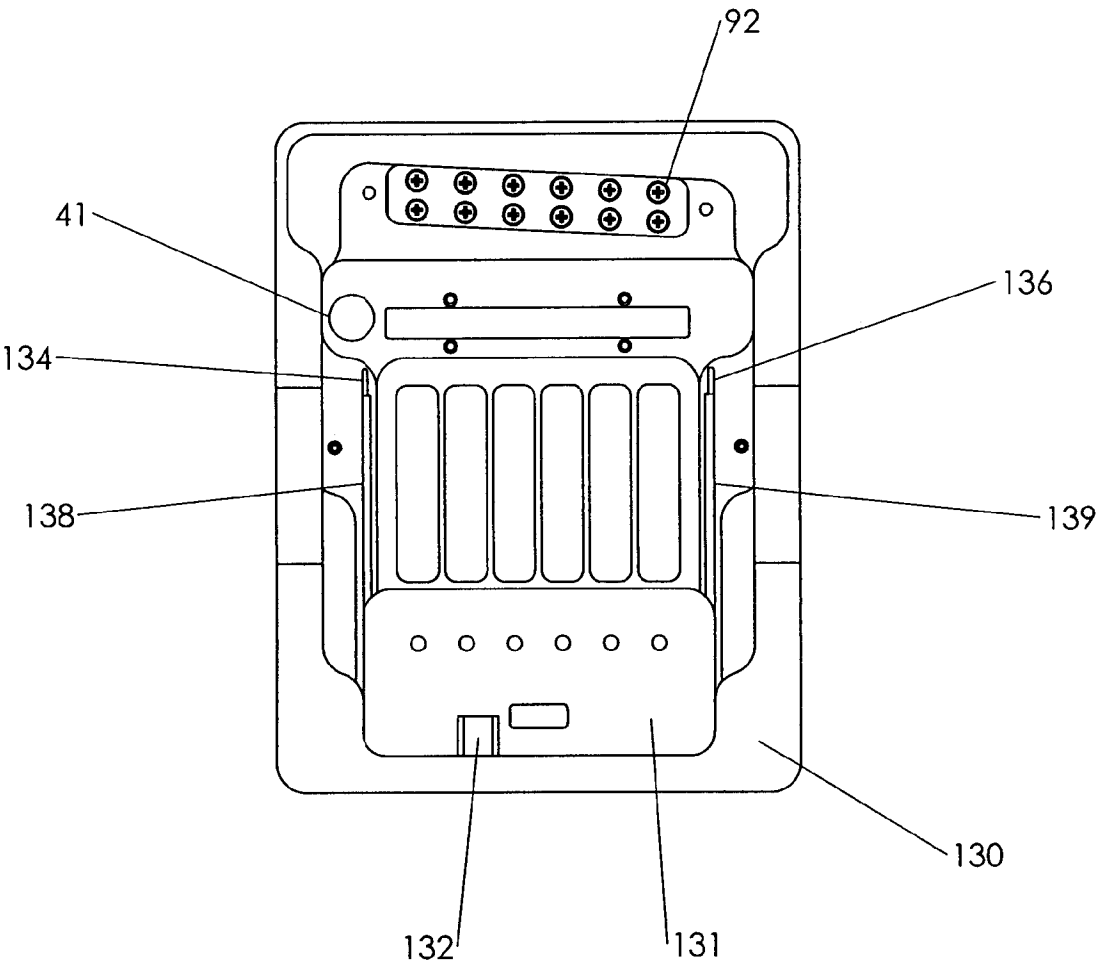
FIG. 11 is a bottom view of the tuning system of this invention with the motor and gear assembly removed showing the limit switch assembly of this invention.

Also shown in FIG. 5 is central processing unit (CPU) circuit board 140, in signal communication with the components of user interface assembly 100 (shown in FIGS. 3 and 4) and motor driver board 142, as well as audio transmitter and radio-frequency command and control transceiver board 150, and user interface board 131 (shown in FIG. 11). Audio transmitter and radio-frequency command and control transceiver board 150 (also referred to herein as an "option board") comprises an audio transmitter and radio-frequency command and control transceiver for wireless communication with optional system components including remote control panel such as a foot switch or panel of buttons or switches to control some or all of the various functions of the system that are also controllable via the controls on user interface panel assembly 100 (FIG. 4) as well as additional functions such as those allowing programming or providing a data link for downloading software governing additional tunings, tempering, adjustment of motor speed, editing, creating, storing and recovering tunings, or for system software updates and other remote functions. The tuning system may also be equipped with noise shielding comprising metal enclosures around the printed circuit boards (not shown).

FIG. 5 further shows battery pack 162 in power connection with the CPU circuit board 140 through battery connector 164. Motor driver board 142, in turn, is in power connection with CPU circuit board 140 via interboard connector 163.

Figure 6:
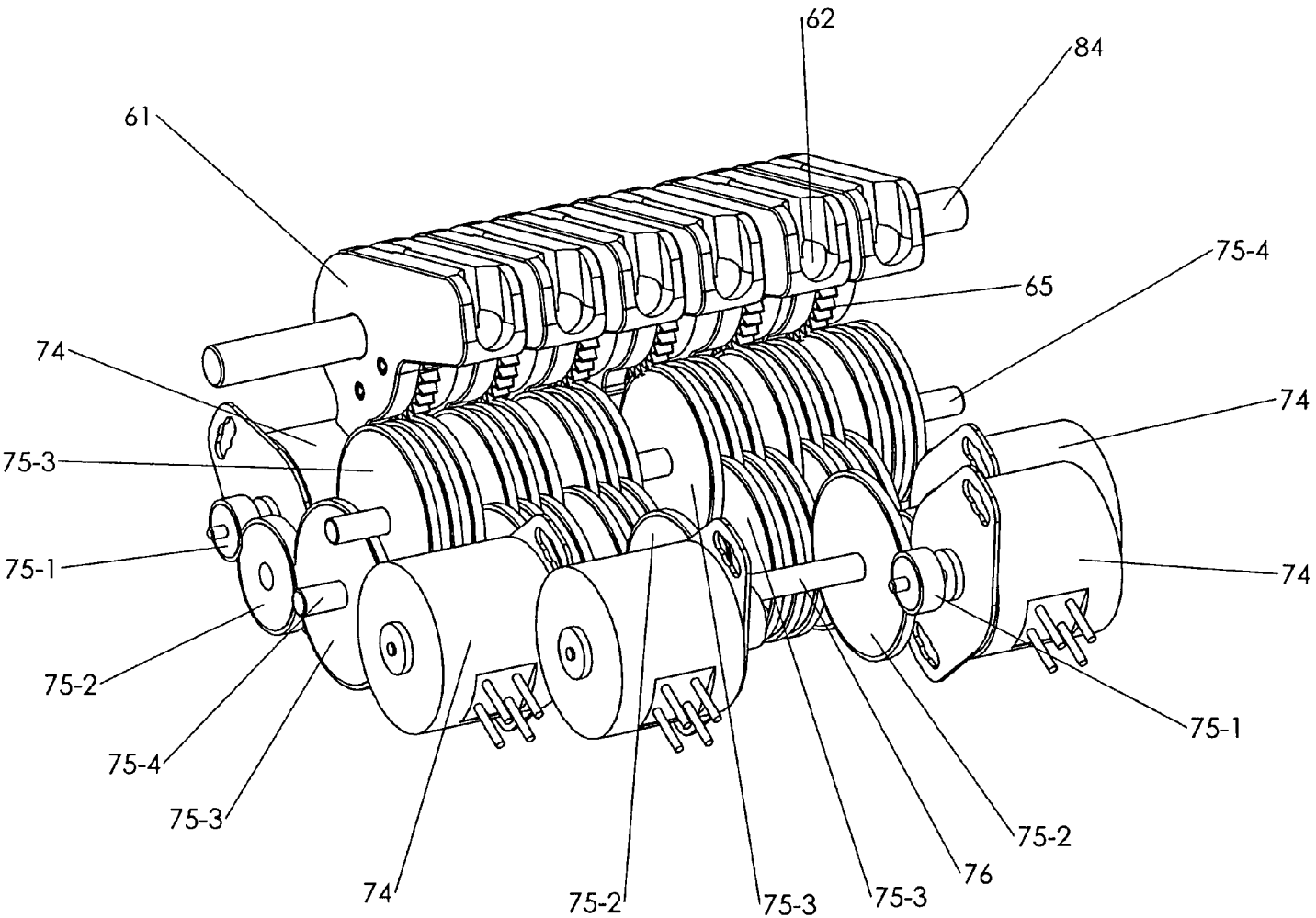
FIG. 6 is a perspective top view of the tune arm assembly and motor and gear assembly showing the internal gear reduction system used in this invention.

FIG. 6 is a perspective internal view of the motor and gear assembly gear reduction system of tuning system 10. The internal gear reduction system comprises gear box 70 comprising motors 74 each having a motor pinion gear 75-1, engaged to an idler gears 75-2 (two large and one small idler gears are shown, the two large gears being connected to each other and supported by idler gear axle 76, which is further engaged to separate gear reduction stages comprising cluster gears 75-3 (one reduction stage for each string), each set of cluster gears 75-3 on cluster gear axle 75-4, engaging via teeth (not shown) with gear teeth 65 of drive gear/string cam 66 (shown in FIG. 7) of a tune arm 61. The gear reduction stages and stepper motors are mounted in gear box 70, which is pivotally attached to upper housing 130 (shown in FIG. 3) on gear box pivot 72.

Figure 7:
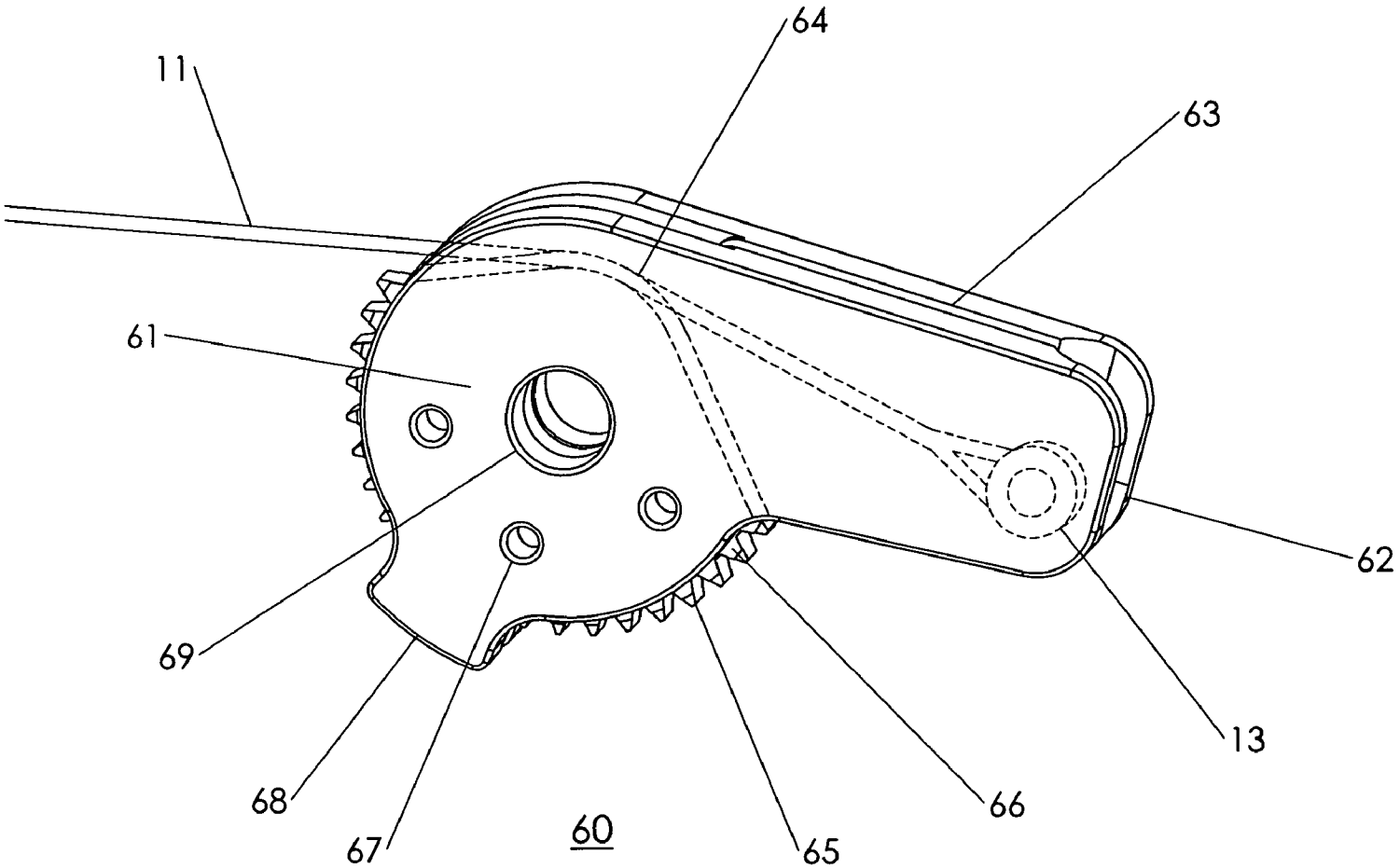
FIG. 7 is a perspective view of a single tune arm of this invention.

FIG. 7 is a perspective view a tune arm assembly 60 of this invention. The tune arm 61 comprises a slot 63 in which string 11 is disposed, and a string ball capture recess 62 in which string ball 13 is disposed. Tune arm 61 in use is pivotally attached to upper housing 130 (shown in FIG. 3) via tune arm axle 84 (also shown in FIG. 3) which extends through axle pivot hole 69. Drive gear/string cam 66, which has an upper string contact surface 64, is fixedly attached to and within tune arm 61 by press pins 67 and its bottom surface comprises drive gear teeth 65 to engage with the motor-powered gear train contained within associated gear box 70 (shown in FIG. 6). When the associated motor for a particular string is activated by means of a signal from the CPU circuit board 140 to motor driver board 142, and thence to the appropriate stepper motor 74 for that string to produce the rotation of the appropriate drive gear/string cam 66 required to achieve the desired frequency, the associated gears turn, causing string contact surface 64 to turn a pre-selected distance, within a preset operating range of preferably about 15 degrees. The radial distance from axle pivot hole 69 to the point where the top surface of string cam 64 contacts string 11 varies from string to string. As is known to the art, the displacement of a string is determined by the formula:

$$S=r\theta$$

where S is the linear distance of string travel, r is the radius r from the center of axle pivot hole 69 to the top edge of string contact surface 64, and θ is the angular degrees of rotation through which string contact surface 64 can be rotated. As will be appreciated by those of skill in the art, the conformation of string contact surface 64 can be adjusted to achieve a desired frequency range for each string. As will be apparent, the radii will therefore be different for each string.

The tune arm assembly also includes a limit switch flag 68 for use in defining an initial position of the arm, as described below with respect to FIG. 11.

Figure 8:
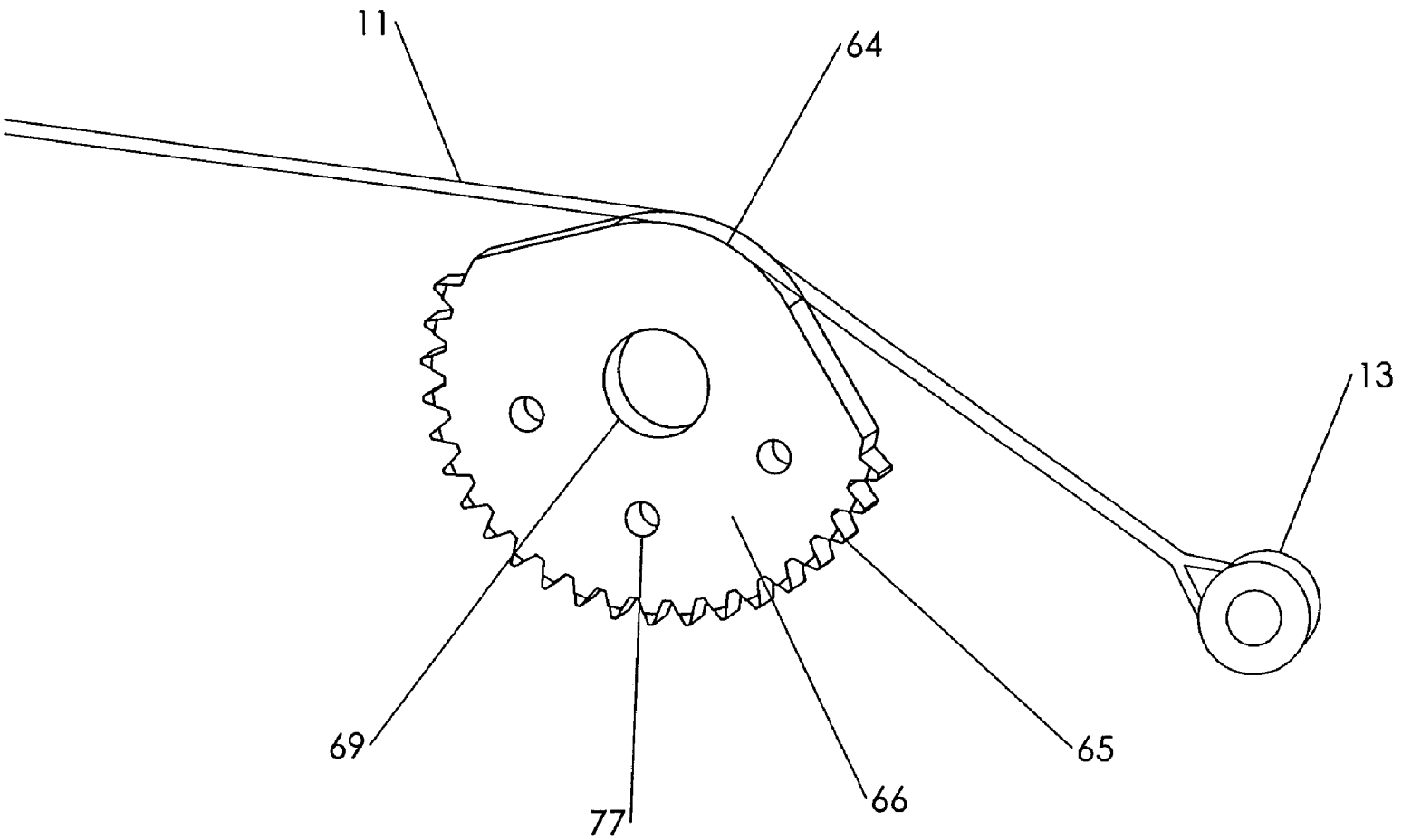
FIG. 8 is a perspective view of a tune arm drive gear/string cam 66 of this invention.

FIG. 8 is a perspective view of a tune arm drive gear/string cam 66 of this invention showing string contact surface 64 in contact with string 11, press pin holes 77, which engage with press pins 67 shown in FIG. 7, pivot hole 69, which receives tune arm axle 84 (shown in FIG. 3), and gear teeth 65 for engaging with cluster gears 75-3 (shown in FIG. 6).

Figure 9:
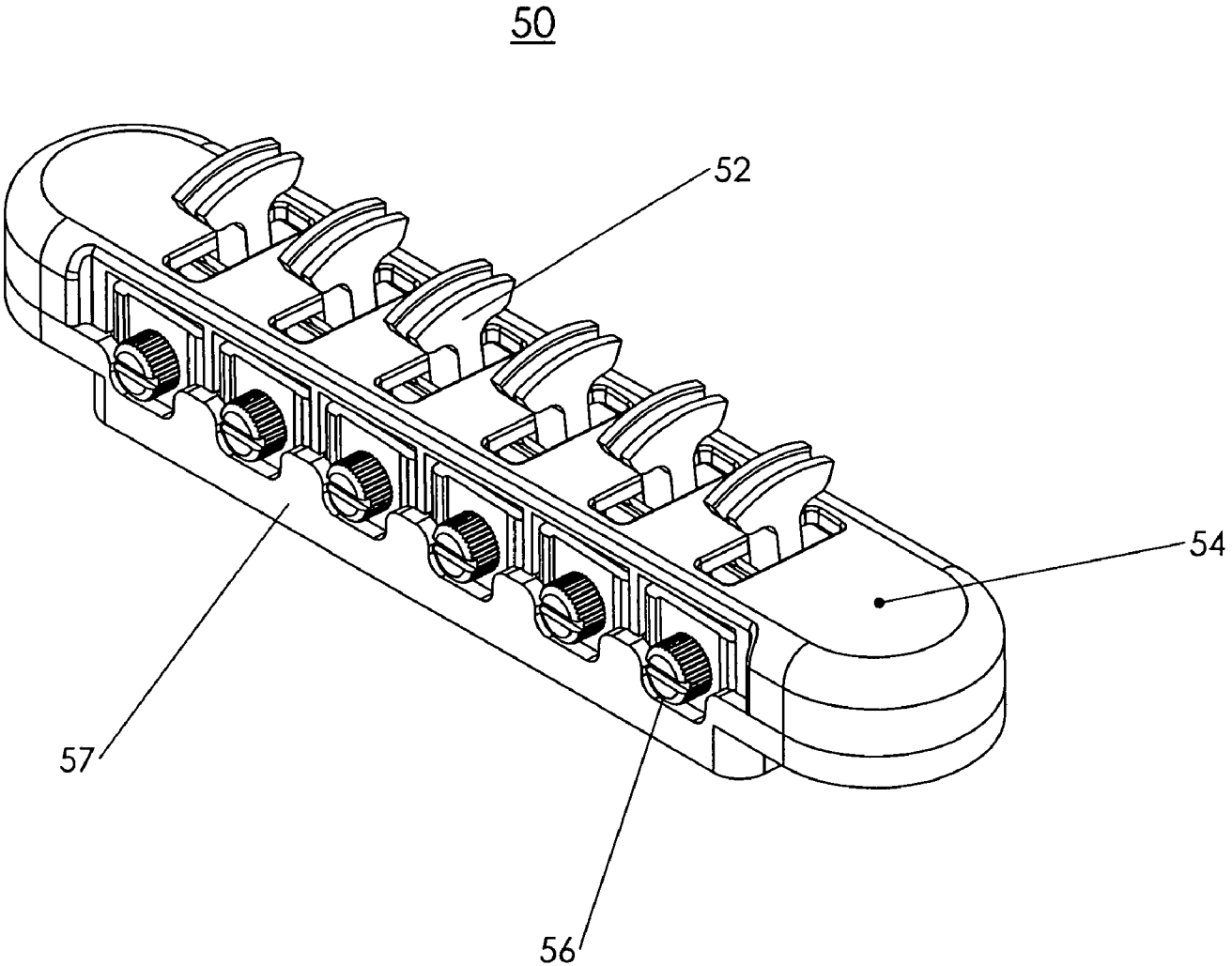
FIG. 9 is a perspective view of a rocker bridge assembly of this invention.

FIG. 9 is a perspective view of a rocker bridge assembly 50 of this invention showing rockers 52 disposed within a housing comprising base 57 and top cap 54. Intonation adjust screws 56 are also shown.

Figure 10:
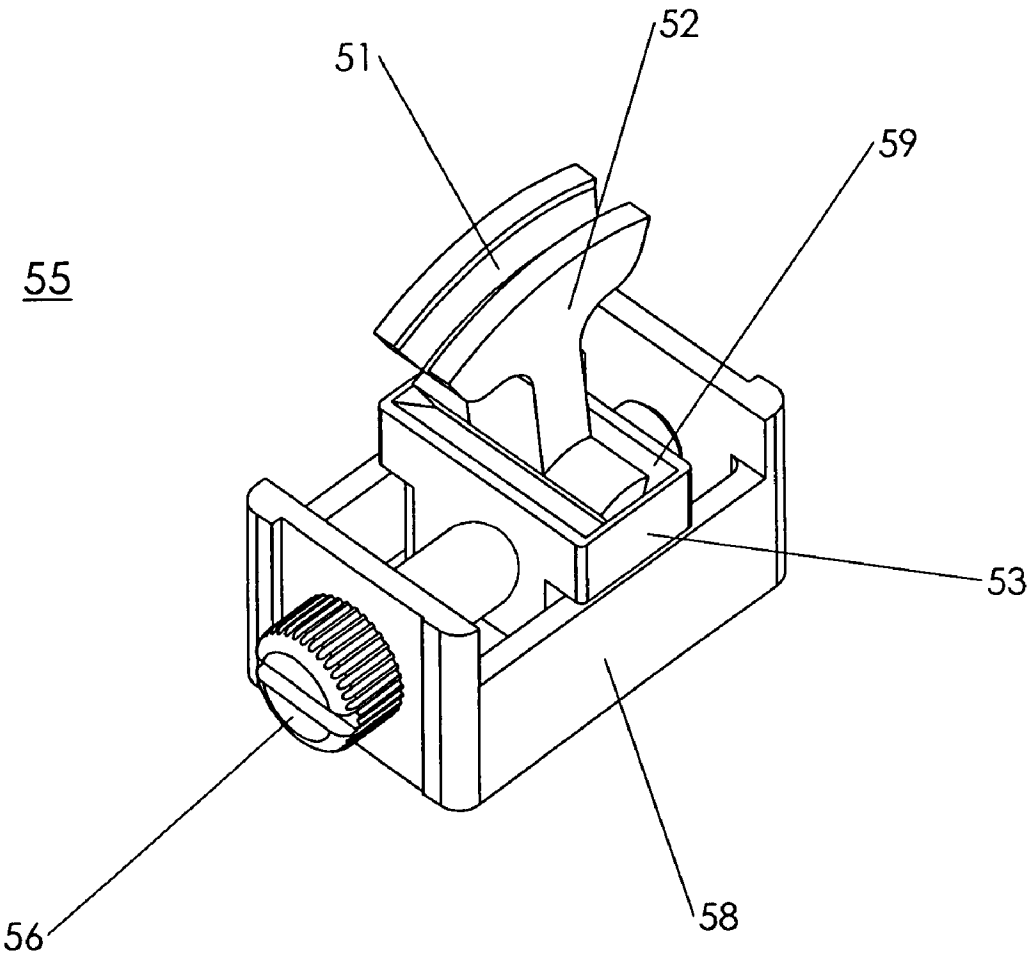
FIG. 10 is a perspective view of a single string cradle assembly from the rocker bridge assembly of this invention.

FIG. 10 is a perspective view of a single string cradle assembly 55 from the rocker bridge assembly 50 of this invention. String groove 51 is designed to receive a string (as shown in FIG. 3), and to rock back and forth on a wedge-shaped base 59 in V-block 53, which has a V-shaped depression designed to allow rocker 52 to rock through a defined arc, thereby allowing the string tension (and frequency) to change without adding friction to the system. V-block 53 is supported in string cradle 58, which is equipped with intonation adjust screw 56 to change the position of V-block 53 and rocker 52 within cradle 58 to adjust string intonation length by making the vibrating length of the string longer or shorter.

FIG. 11 is a bottom view of the tuning system of this invention with the motor and gear assembly removed showing the limit switch assembly of this invention. The limit switch assembly includes a limit switch optical emitter 136 powered by optical emitter power cable 139 on one side of the device and a limit switch optical receiver 134 connected to optical receiver signal cable 138 on the other side, which is connected to CPU circuit board 140 via user interface board 131 (FIG. 11). When a limit switch flag 68 on an activated tuning arm 61 (see FIG. 7) rotates so as to break the beam between optical emitter 136 and optical receiver 134, a signal is sent via optical receiver signal cable 138 to CPU circuit board 140 via the user interface board 131, causing it to set this position as a zero point from which all relative motor movements in either direction are referenced.

Also visible in FIG. 11 is vibrato mount hole 41 and string height adjust screws 92 which can be raised or lowered for adjusting the height of the string cradle assemblies 55, and thereby the string height, so as to adjust the height of the strings off of the neck 26 for individual player preferences. The Power and USB Input/output port 132 in upper housing 130 is also shown.

Figure 12:
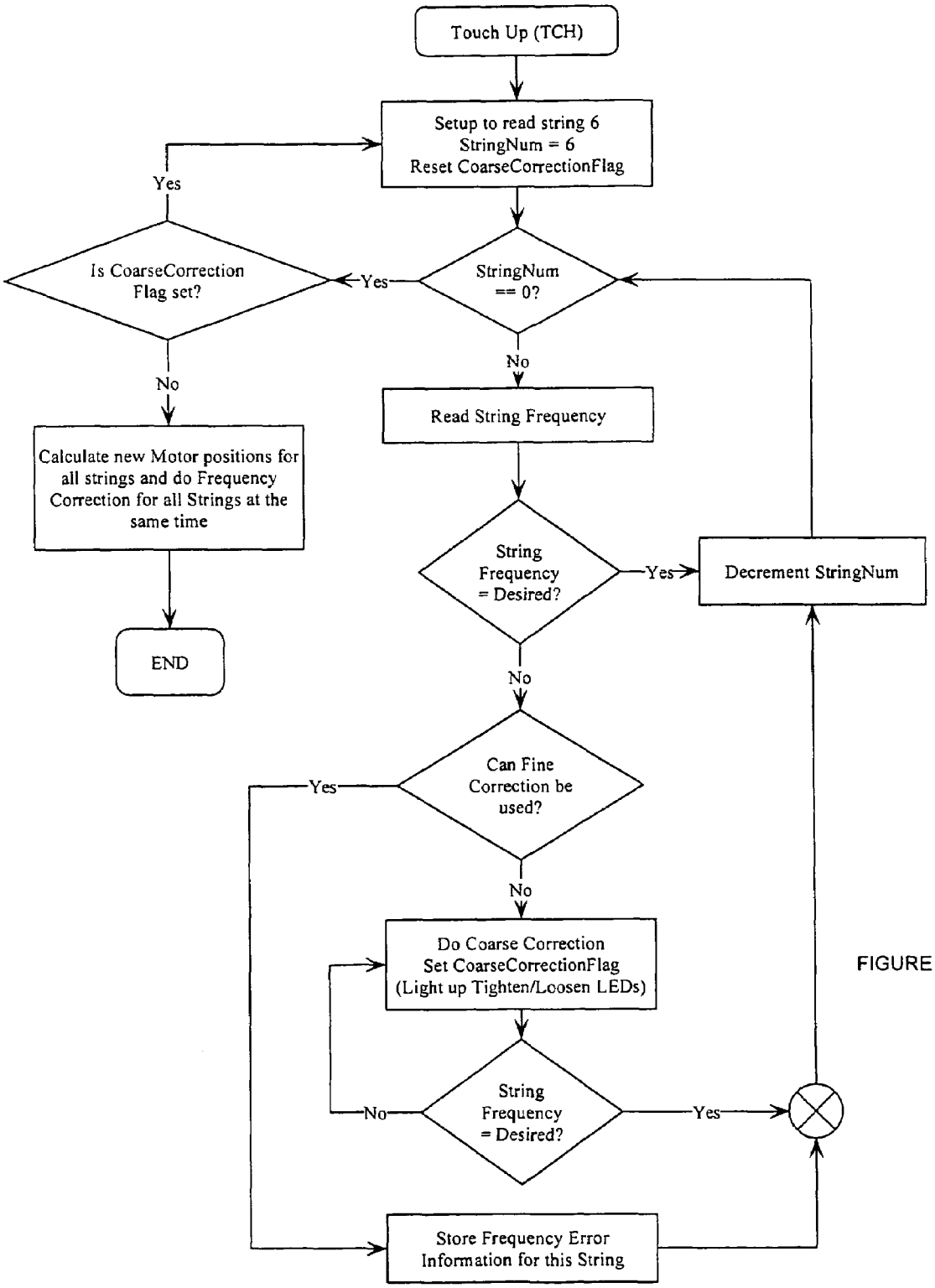
FIG. 12 is an electrical system block diagram showing components of the tuning system of this invention.

FIG. 12 is an electrical system block diagram showing components of the tuning system of this invention which reside on the various electrical circuit boards. Block T represents an existing guitar pickup such as that shown as item 28 in FIG. 1. The pickup transmits the sound produced when a string is strummed to a lowpass filter and gain stage, then onto a tunable band pass filter, which filters out frequencies outside of the range of interest for each string. The center frequency of the bandpass filter can be adjusted by the CPU to create a moving window to allow only those frequencies associated with each string, in turn, to be allowed to pass. The signal is then converted from an analog to a digital signal by a comparator and turned into a square wave for transmission to the CPU circuit board 140 (shown in FIG. 5).*The* CPU circuit board 140 measures the frequency of the square wave signal and then sends a signal through motor driver board 142 (shown in FIG. 5) to the separate stepper motors 74 associated with each string (shown in FIG. 5 and labeled M1 through M6 in FIG. 12). The CPU circuit board 140 is also in signal communication with a battery charger connected to battery pack 162 and also provides a "gas gauge" that can be used to relay the current charge state of the battery. The CPU circuit board 140 is also in signal communication with the user interface board 131 (FIG. 11) and audio transmitter and radio frequency command and control transceiver 150 (FIG. 5) (also referred to herein as an "option board") by which additional features, as described above, can be wirelessly connected to the system.

To operate the system, the guitar is strung by placing the string ball 13 of a conventional string 11 in string ball capture recess 62 of the appropriate tune arm 61, and running the string through tune arm slot 63, and then under the appropriate string guide roller 80, then seating the string in the appropriate string groove 51 (FIG. 10) of the appropriate rocker 52, and passing the string up the guitar neck 26 and attaching it to the appropriate tuning peg 18. The purpose of rollers 80 is to ensure that the strings stay in constant contact with the string contact surfaces 64 (FIG. 7) of the drive gear/string cams 66 so that their rotation will be able to change the frequency emitted by each string.

The touch up tuning procedure of this invention can then be initiated. The term "touch up" refers to the tuning correction process of this invention.

Figure 13:
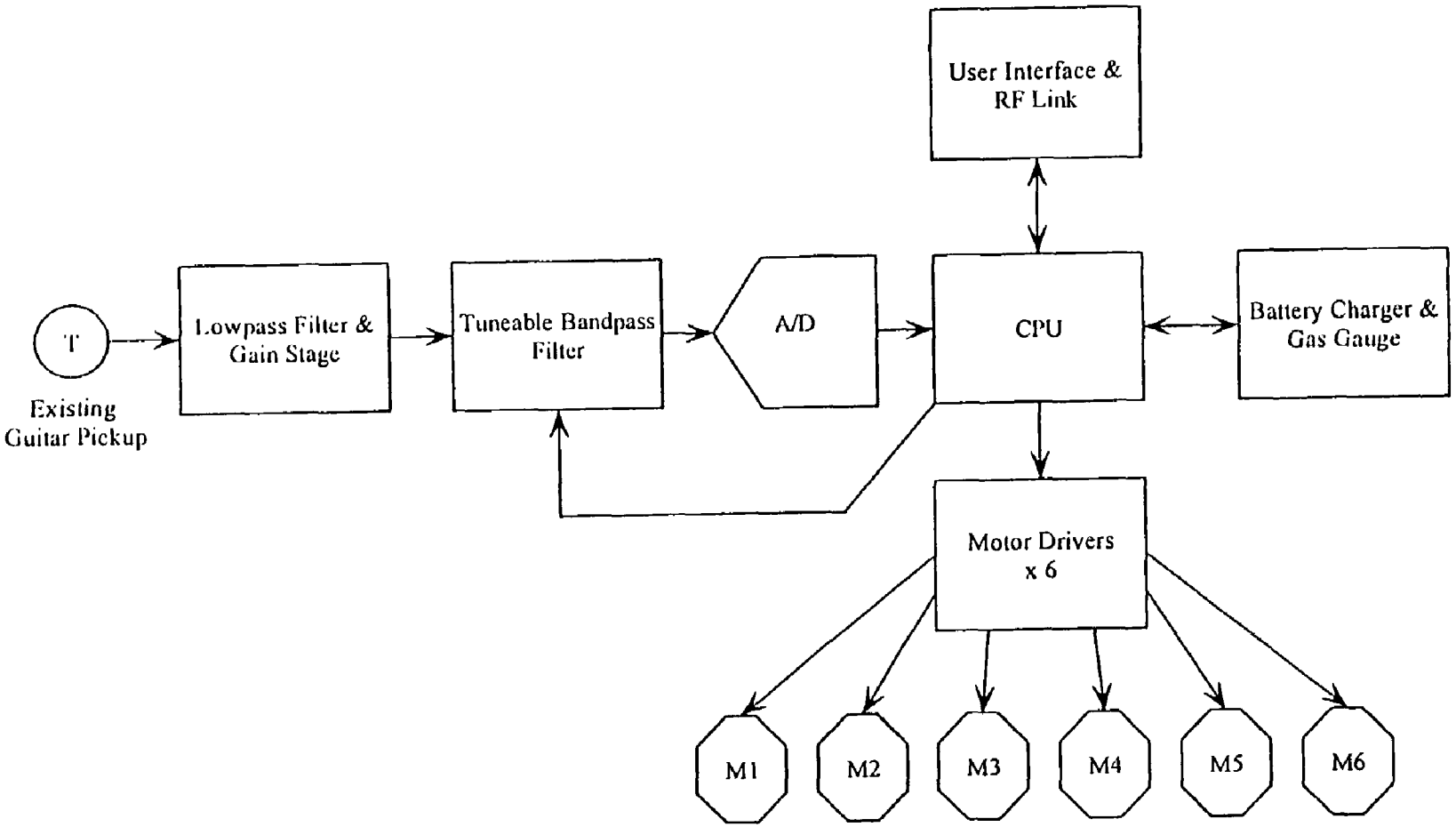
FIG. 13 is a flow chart showing the touch-up tuning procedure of this invention.

FIG. 13 is a flow chart illustrating the tuning procedure. When the user momentarily depresses and releases the ("TCH/PWR") power/touch up button 112 (FIG. 4), when the system is already powered on, the LED 102 (FIG. 4) corresponding to the string having the lowest frequency range designated String 6, is activated to display a green light, and the other LEDs, corresponding to Strings designated 5-1 respectively from lowest to highest, are activated to display red lights. The green light instructs the user to strum String 6, and the red lights instruct the user to mute all other strings while strumming String 6. Once the user has strummed String 6, the corresponding LED turns yellow to instruct the user not to touch the string while it is vibrating and the system is acquiring the frequency signal.

The guitar pickups capture the sound from String 6 and convey a corresponding frequency signal to CPU circuit board 140 where the frequency is compared with the desired frequency for that string. If the string is properly tuned and there is no difference between the actual and desired frequency, the String number is set to String 5 and the process repeated.

If there is a difference between the actual and desired frequencies for String 6, the CPU circuit board 140 determines whether the difference is greater or less than a predetermined difference, wherein a greater difference will require the user to perform coarse correction, and a lesser difference will allow the system to automatically perform a fine correction to bring the string into proper tune. The predetermined difference in which the fine correction can be automatically performed is set by system parameters including the length and mass of the string, the freedom of movement of the tune arm 61, and the radii of string cam 66, as well as memory stored in the CPU of the previous tuning adjustments made to that string by the tuning system as described below.

If coarse correction is required, a coarse correction flag is set in software memory, and the appropriate string adjustment indicators (FIG. 4) are activated. If the actual frequency is too low, tighten string indicator 106 is activated. If the actual frequency is too high, loosen string indicator 110 is activated. The user then uses the tuning pegs to tighten or loosen the string. Meanwhile, the LED for String 6 is activated to become green and the LEDs for the other strings are activated to become red, indicating that the user must again strum String 6 and mute the other strings. This process is repeated until the actual string frequency is within the range in which the system can perform a fine correction. At that point Aligned "in tune" indicator 108 is activated to indicate that the user does not need to do further manual adjustments of that string. The fact that a coarse correction was required on any string is retained in memory and used at the very end of this procedure.

When the actual string frequency is within the range in which the system can perform a fine correction, the CPU circuit board 140 stores the frequency error for that string and goes onto the next string.

Once the fine correction error has been determined for String 6, the error is stored in memory and the string number is then decremented to the next lower number. The process is repeated until the string number is zero. The LEDs corresponding to each string is activated, as described above for String 6, when that string is being tuned.

When the string number is 0, the system checks to see if the coarse correction was done to any string, If so, the procedure is repeated from the beginning until the string number is again 0 and the coarse correction flag is not set. This is to account for the effect that coarse tuning of one string has on all the other strings. Once the entire procedure is done without there having been a need for a coarse correction, then motor positions for the desired frequencies for all the strings are calculated, and the CPU circuit board 140 sends a signal through motor driver board 142 to activate the motors 74 associated with each string to turn the associated gears to move the associated drive gear/string cams 66 the proper distance in the proper direction to cause the required change in string tension for each string to achieve its desired frequency, so as to fine-tune all the strings at the same time.

The change in motor movement required to achieve the desired change in frequency for each string are stored in memory for each string, so that this data can be used to calculate the change in motor position required for the next tuning correction. The correct motor movement for each string is calculated by an algorithm that takes into account the amount of motor movement previously required to achieve the previously-required frequency change, as well as other system parameters as described above and known to the art. The first time the tuning correction procedure of this invention is applied, or whenever the system is reset, e.g., when strings are replaced, the algorithm refers to a generic set of motor movement instructions for each string and each tuning to achieve the frequency change for each string required by the selected tuning, these instructions are referred to herein as "generic predetermined calibrations." These generic calibrations are in accordance with principles set forth in U.S. Pat. No. 5,824,929 (incorporated herein by reference to the extent not inconsistent herewith) for determining actuator positions for target frequencies. Preferably the changes in string tension (produced by string elongation) for a given amount of motor movement are determined using as few parameters as possible, such as instrument neck characteristics, string mass, cross-sectional area, length, modulus of elasticity, desired frequency. Values for these parameters are set as average values for the class of instruments on which the tuning system is to be installed, or preferably, representative instruments of the class of instruments are testing using different gauge strings, to determine a matrix of motor positions and frequencies, and the matrix diagonalized to produce coefficients for a set of multivariable equations as defined in U.S. Pat. No. 5,824,929. This helps account for the effect that tightening or loosening of each string has on the other strings. The generic predetermined calibrations for each class of instrument are then stored in the processors of the tuning systems designed for these instruments and used in the algorithms that perform the fine-tuning corrections.

When the first tuning correction procedure has been performed using the generic predetermined calibrations, the motor adjustments required to achieve further frequency corrections (offset calibrations) are stored, and the next time the tuning correction procedure is performed, the algorithm also utilizes these offset calibrations to adjust string frequency, also as described in U.S. Pat. No. 5,824,929. This reference to stored generic calibrations and/or remembered offset calibrations is referred to herein as "open loop feedback," in contrast to "closed-loop feedback" which refers only to actual and desired frequencies without reference to previously-stored motor movement instructions. Use of open-loop feedback allows the tuning system to automatically improve the efficiency and accuracy of its tuning corrections every time the procedure is done.

After all the strings have been fine-tuned by the system, all LEDs 102 will be off, indicating that the guitar is ready to be played. At this point, the user may wish to tighten an optional string lock, if installed at location 22 (FIG. 1), to help maintain tuning stability and reproducibility.

The CPU circuit board is also designed to memorize the tuning to which the strings were last set, e.g., open A, open E, and the like, so that when the power is turned off, the system will still be set to that tuning when the power is turned back on.

After the first time the tuning correction procedure of this invention has been performed for all strings in all desired different tunings, the user will be able to change tunings while playing the instrument simply by depressing the appropriate tuning selector button for the desired different tuning, and the tuning system will automatically change the frequencies produced by each string as required for the new tuning using the remembered motor movement instructions.

In one embodiment of this invention, the rocker bridge assembly 50 is a piezo rocker bridge assembly as described in U.S. Patent Publication 2003/0177894 of Skinn, published Sep. 25, 2003, incorporated herein by reference to the extent not inconsistent herewith. The rocker bridge performs the normal functions of a bridge in setting the length of the strings for proper tuning and setting the height of the strings in accordance with user preferences. The rocker bridge additionally provides a substantially frictionless, moveable saddle, to keep the friction associated with automatically changing the string length and tension when a conventional bridge is used from interfering with the tuning correction procedure. When separate transducers are used for each string, as described in said patent publication, the frequencies of all six strings can be collected simultaneously, with one strum.

This invention has been described by reference to specific components and methods; however, as will be appreciated by those of skill in the art, additional and/or substitute methods and components that are equivalent to those described may also be used, and are included within the scope of the appended claims.

The invention claimed is:

1. An automatic tuning system for performing automatic fine tuning corrections on a stringed instrument, said tuning system comprising:

a detector for detecting a musical tone produced by an activated string and producing a signal value corresponding to said tone;

a processor coupled to said detector for comparing said signal to a reference frequency value associated with a desired frequency and producing an electrical control signal, said electrical control signal being a function of the difference between said signal value and said reference frequency value; and a string adjustment assembly coupled to said processor and to said string for adjusting the tension of said string to cause a frequency change required to reach said desired frequency, in dependence upon said electrical control signal, said string adjustment assembly comprising:

a motor and gear assembly pivotally attached to a housing for said automatic tuning system;

a tune arm to which said string is anchored;

a string contact surface of a drive gear/string cam contained within said tune arm, said string contact surface being in adjustable tangential contact with said string;

a gear of said motor and gear assembly in rotational contact with said drive gear/string cam; and a motor of said motor and gear assembly responsive to said electrical signal in rotational contact with said gear;

whereby changing the position of said string contact surface with respect to said string changes the frequency produced by said string when activated such that said string produces said desired frequency.

2. The automatic tuning system of claim 1 wherein said instrument is a guitar.

3. The automatic tuning system of claim 1 wherein all said components are built in to said instrument.

4. The automatic tuning system of claim 1 also comprising a user interface comprising signal components for instructing a user to strum each individual string in turn.

5. The automatic tuning system of claim 4 wherein said user interface also comprises signal components instructing said user to perform a coarse tuning routine comprising manually adjusting the tension of at least one individual string, and to inform the user when the string must be manually tightened, loosened, or does not need to be further manually tightened or loosened, said signals being activated when the difference between said signal value produced by said tone and said reference frequency value is greater than a value permitting automatic fine tuning correction of said string.

6. The automatic tuning system of claim 1 wherein said processor also comprises stored predetermined generic calibration values for motor movement instructions for achieving said frequency change for each string.

7. The automatic tuning system of claim 6 wherein said processor comprises said stored predetermined generic calibration values for each string for a plurality of desired tunings.

8. The automatic tuning system of claim 1 also comprising an option board that comprises an audio transmitter and radio-frequency command and control transceiver for wireless communication with optional system components.

9. The automatic tuning system of claim 8 wherein said remote device is a processor.

10. The automatic tuning system of claim 1 also comprising a rocker bridge in contact with said string for keeping the vibrating string length constant and setting the height of each string at the bridge during tension adjustment.

11. An automatic tuning system of claim 1 also comprising a user interface for instructing a user to activate an individual string of said instrument that has been selected to be tuned.

12. A method of tuning a stringed instrument comprising:
providing the automatic tuning system of claim 1;
strumming the strings of said instrument; and
allowing said tuning system to automatically and simultaneously perform fine tuning corrections by adjusting the tension of any and all strings of said instrument requiring correction.

13. A method of tuning a stringed instrument comprising:
providing the automatic tuning system of claim 1;
strumming the strings of said instrument;
allowing said tuning system to automatically and simultaneously perform fine tuning corrections by adjusting the tension of any and all strings of said instrument requiring correction; and
changing the tuning of said instrument to a different tuning while playing said instrument without again strumming any string of said instrument, said method comprising activating an algorithm that causes all strings of said instrument to be automatically adjusted as required for said tuning using stored predetermined generic calibration and offset calibration values for said different tuning.

14. The method of claim 13 comprising strumming the strings simultaneously.

15. The method of claim 13 comprising strumming each string individually.

16. The method of claim 13 also comprising: after strumming each individual string of said instrument, manually performing a coarse tuning of each string requiring coarse tuning before allowing said tuning system to automatically perform said fine tuning corrections.

17. The tuning system of claim 1 also comprising a rocker bridge in contact with said string.

18. An automatic tuning system for performing automatic fine tuning corrections on a stringed instrument, said tuning system comprising:
a detector for detecting a musical tone produced by an activated string and producing a signal value corresponding to said tone;
a processor coupled to said detector for comparing said signal to a reference frequency value associated with a desired frequency and producing an electrical control signal, said electrical control signal being a function of the difference between said signal value and said reference frequency value; wherein said processor comprises:
stored predetermined generic calibration values for motor movement instructions for achieving said frequency change for each string for a plurality of desired tunings; and
an algorithm for storing offset calibration values for each string calculated using a tuning correction performed on said string, and for using said stored offset calibration values and said predetermined generic calibration values to recalculate the amount of movement of said motors necessary to perform the next automatic tuning correction; and
a string adjustment assembly coupled to said processor and to said string for adjusting the tension of said string to cause a frequency change required to reach said desired frequency, in dependence upon said electrical control signal, said string adjustment assembly comprising:
a motor and gear assembly pivotally attached to a housing for said automatic tuning system;
a tune arm to which said string is anchored;
a string contact surface of a drive gear/string cam contained within said tune arm, said string contact surface being in adjustable tangential contact with said string;
a gear of said motor and gear assembly in rotational contact with said drive gear/string cam; and
a motor of said motor and gear assembly responsive to said electrical signal in rotational contact with said gear;
whereby changing the position of said string contact surface with respect to said string changes the frequency produced by said string when activated such that said string produces said desired frequency.

19. The automatic tuning system of claim 18 also comprising a controller that allows a user to change to a different tuning without producing a tone by activating an algorithm that changes the tension of the strings using the appropriate stored predetermined generic calibration and offset calibration values for the different tuning.

20. An automatic tuning system for performing automatic fine tuning corrections on a stringed instrument, said tuning system comprising:
a detector for detecting a musical tone produced by an activated string and producing a signal value corresponding to said tone;
a processor coupled to said detector for comparing said signal to a reference frequency value associated with a desired frequency and producing an electrical control signal, said electrical control signal being a function of the difference between said signal value and said reference frequency value;
a string adjustment assembly coupled to said processor and to said string for adjusting the tension of said string to cause a frequency change required to reach said desired frequency, in dependence upon said electrical control signal, said string adjustment assembly comprising a motor and gear assembly pivotally attached to a housing for said automatic tuning system; and an option board that comprises an audio transmitter and radio-frequency command and control transceiver for wireless communication with optional system components;

wherein said option board is in wireless communication with a remote device selected from the group consisting of a detector, a processor, a remote control panel in the form of a foot switch or hand control device for controlling tuning correction functions of the tuning system comprising a function selected from the group consisting of power activation, initiation of a tuning correction procedure, detection of a tone, and selection of desired tunings, a remote electronic storage device from which data or software can be uploaded or downloaded or updated for use in performing system functions or tuning the instrument to additional tunings, a device for adjusting motor speed, a device for editing, creating, storing and/or recovering previously-used tunings, another instrument, and an audio device for receiving sound.

21. An automatic tuning system for performing automatic fine tuning corrections on a stringed instrument, said tuning system comprising:

a detector for detecting a musical tone produced by an activated string and producing a signal value corresponding to said tone;

a processor coupled to said detector for comparing said signal to a reference frequency value associated with a desired frequency and producing an electrical control signal, said electrical control signal being a function of the difference between said signal value and said reference frequency value; and a string adjustment assembly coupled to said processor and to said string for adjusting the tension of said string to cause a frequency change required to reach said desired frequency, in dependence upon said electrical control signal, said string adjustment assembly comprising:

a motor and gear assembly; and a tune arm to which said string is anchored;

a string contact surface of a drive gear/string cam contained within said tune arm, said string contact surface being in adjustable tangential contact with said string;

a gear of said motor and gear assembly in rotational contact with said drive gear/string cam; and a motor of said motor and gear assembly responsive to said electrical signal in rotational contact with said gear;

whereby changing the position of said string contact surface with respect to said string changes the frequency produced by said string when activated such that said string produces said desired frequency.

22. An automatic tuning system for performing automatic fine tuning corrections on a stringed instrument, said tuning system comprising:

a detector for detecting a musical tone produced by an activated string and producing a signal value corresponding to said tone;

a processor coupled to said detector for comparing said signal to a reference frequency value associated with a desired frequency and producing an electrical control signal, said electrical control signal being a function of the difference between said signal value and said reference frequency value; wherein said processor comprises:

stored predetermined generic calibration values for motor movement instructions for achieving said frequency change for each string for a plurality of desired tunings; and an algorithm for storing offset calibration values for each string calculated using a tuning correction performed on said string, and for using said stored offset calibration values and said predetermined generic calibration values to recalculate the amount of movement of said motors necessary to perform the next automatic tuning correction; and a string adjustment assembly coupled to said processor and to said string for adjusting the tension of said string to cause a frequency change required to reach said desired frequency, in dependence upon said electrical control signal, said string adjustment assembly comprising:

a motor and gear assembly;

a tune arm to which said string is anchored;

a string contact surface of a drive gear/string cam contained within said tune arm, said string contact surface being in adjustable tangential contact with said string;

a gear of said motor and gear assembly in rotational contact with said drive gear/string cam; and a motor of said motor and gear assembly responsive to said electrical signal in rotational contact with said gear;

whereby changing the position of said string contact surface with respect to said string changes the frequency produced by said string when activated such that said string produces said desired frequency.

23. The automatic tuning system of claim 22 also comprising a controller that allows a user to change to a different tuning without producing a tone by activating an algorithm that changes the tension of the strings using the appropriate stored predetermined generic calibration and offset calibration values for the different tuning.

24. An automatic tuning system for performing automatic fine tuning corrections on a stringed instrument, said tuning system comprising:

a detector for detecting a musical tone produced by an activated string and producing a signal value corresponding to said tone;

a processor coupled to said detector for comparing said signal to a reference frequency value associated with a desired frequency and producing an electrical control signal, said electrical control signal being a function of the difference between said signal value and said reference frequency value;

a string adjustment assembly coupled to said processor and to said string for adjusting the tension of said string to cause a frequency change required to reach said desired frequency, in dependence upon said electrical control signal, said string adjustment assembly comprising a motor and gear assembly; and an option board that comprises an audio transmitter and radio-frequency command and control transceiver for wireless communication with optional system components; wherein said option board is in wireless communication with a remote device selected from the group consisting of a detector, a processor, a remote control panel in the form of a foot switch or hand control device for controlling tuning correction functions of the tuning system comprising a function selected from the group consisting of power activation, initiation of a tuning correction procedure, detection of a tone, and selection of desired tunings, a remote electronic storage device from which data or software can be uploaded or downloaded or updated for use in performing system functions or tuning the instrument to additional tunings, a device for adjusting motor speed, a device for editing, creating, storing and/or recovering previously-used tunings, another instrument, and an audio device for receiving sound.

25. A method of tuning a stringed instrument comprising:

providing an automatic tuning system for performing automatic fine tuning corrections on a stringed instrument, said tuning system comprising:

a detector for detecting a musical tone produced by an activated string and producing a signal value corresponding to said tone;

a processor coupled to said detector for comparing said signal to a reference frequency value associated with a desired frequency and producing an electrical control signal, said electrical control signal being a function of the difference between said signal value and said reference frequency value; and a string adjustment assembly coupled to said processor and to said string for adjusting the tension of said string to cause a frequency change required to reach said desired frequency, in dependence upon said electrical control signal, said string adjustment assembly comprising:

a motor and gear assembly;

a tune arm to which said string is anchored;

a string contact surface of a drive gear/string cam contained within said tune arm, said string contact surface being in adjustable tangential contact with said string;

a gear of said motor and gear assembly in rotational contact with said drive gear/string cam; and a motor of said motor and gear assembly responsive to said electrical signal in rotational contact with said gear;

whereby changing the position of said string contact surface with respect to said string changes the frequency produced by said string when activated such that said string produces said desired frequency;

strumming the strings of said instrument;

allowing said tuning system to automatically and simultaneously perform fine tuning corrections by adjusting the tension of any and all strings of said instrument requiring correction; and changing the tuning of said instrument to a different tuning while playing said instrument without again strumming any string of said instrument, said method comprising activating an algorithm that causes all strings of said instrument to be automatically adjusted as required for said tuning using stored predetermined generic calibration and offset calibration values for said different tuning.

26. The method of claim 25 also comprising: after strumming each individual string of said instrument, manually performing a coarse tuning of each string requiring coarse tuning before allowing said tuning system to automatically perform said fine tuning corrections.

* * * * *